US007358666B2

(12) United States Patent
Bewlay et al.

(10) Patent No.: US 7,358,666 B2
(45) Date of Patent: Apr. 15, 2008

(54) SYSTEM AND METHOD FOR SEALING HIGH INTENSITY DISCHARGE LAMPS

(75) Inventors: Bernard Patrick Bewlay, Schenectady, NY (US); Bruce Alan Knudsen, Amsterdam, NY (US); James Anthony Brewer, Scotia, NY (US)

(73) Assignee: General Electric Company, Niskayuna, NY (US)

( * ) Notice: Subject to any disclaimer, the term of this patent is extended or adjusted under 35 U.S.C. 154(b) by 490 days.

(21) Appl. No.: 10/952,940

(22) Filed: Sep. 29, 2004

(65) Prior Publication Data

US 2006/0068679 A1 Mar. 30, 2006

(51) Int. Cl.
*H01J 17/22* (2006.01)
*H01J 61/24* (2006.01)
*H05B 1/00* (2006.01)

(52) U.S. Cl. ..... 313/547; 219/200; 219/485; 219/402; 219/405; 313/549

(58) Field of Classification Search ..... None
See application file for complete search history.

(56) References Cited

U.S. PATENT DOCUMENTS 3,363,134 A 1/1968 Johnson
3,385,463 A 5/1968 Lange
3,659,138 A 4/1972 Johnson et al.
3,662,455 A 5/1972 Anderson
3,693,007 A 9/1972 Kerekes
3,872,341 A 3/1975 Werner et al.
3,882,344 A 5/1975 Knochel et al.
3,882,346 A 5/1975 McVey
3,909,736 A * 9/1975 Huchital et al. ..... 372/71
3,953,177 A 4/1976 Sedlatschek et al.
4,103,200 A 7/1978 Bhalla
4,291,250 A 9/1981 Bhalla
4,409,517 A 10/1983 Van Der Sande et al.
4,464,603 A 8/1984 McVey
4,507,584 A 3/1985 Coaton et al.
4,545,799 A 10/1985 Rhodes et al.

(Continued)

FOREIGN PATENT DOCUMENTS

EP 0935278 8/1999

(Continued)

OTHER PUBLICATIONS

U.S. Appl. No. 10/323,252, filed Dec. 17, 2003, Bewlay et al.

(Continued)

*Primary Examiner*—Mariceli Santiago
*Assistant Examiner*—Natalie K. Walford
(74) *Attorney, Agent, or Firm*—Fletcher Yoder

(57) ABSTRACT

In accordance with certain embodiments, the present technique includes a system for sealing a lamp including a thermal shield and a thermally susceptible enclosure disposed adjacent the thermal shield. The thermal shield has a first receptacle adapted to receive a first portion of the lamp. The thermally susceptible enclosure comprises a wall about a second receptacle adapted to receive a second portion of the lamp. The wall has a varying thickness in a desired sealing region between the first and second portions of the lamp.

58 Claims, 15 Drawing Sheets

U.S. PATENT DOCUMENTS

| | | | | |
|---|---|---|---|---|
| 4,585,972 | A | 4/1986 | Hing | |
| 4,707,636 | A | 11/1987 | Morris | |
| 4,780,646 | A | 10/1988 | Lange | |
| 4,804,889 | A | 2/1989 | Reid et al. | |
| 5,057,048 | A | 10/1991 | Feuersanger et al. | |
| 5,321,335 | A | 6/1994 | Klug et al. | |
| 5,424,609 | A | 6/1995 | Geven et al. | |
| 5,426,343 | A | 6/1995 | Rhodes et al. | |
| 5,552,670 | A | 9/1996 | Heider et al. | |
| 5,725,827 | A | 3/1998 | Rhodes et al. | |
| 5,783,907 | A | 7/1998 | Suzuki et al. | |
| 5,973,453 | A | 10/1999 | Van Viet et al. | |
| 5,994,839 | A | 11/1999 | Yamamoto et al. | |
| 6,069,456 | A | 5/2000 | Fromm et al. | |
| 6,126,889 | A | 10/2000 | Scott et al. | |
| 6,156,079 | A * | 12/2000 | Ho et al. | 29/25.01 |
| 6,215,254 | B1 | 4/2001 | Honda et al. | |
| 6,216,889 | B1 | 4/2001 | Chang | |
| 6,265,827 | B1 | 7/2001 | Takahashi et al. | |
| 6,294,871 | B1 | 9/2001 | Scott et al. | |
| 6,300,716 | B1 | 10/2001 | Honda et al. | |
| 6,375,533 | B1 | 4/2002 | Torikai et al. | |
| 6,404,129 | B1 | 6/2002 | Hendricx et al. | |
| 6,528,945 | B2 | 3/2003 | Kelly et al. | |
| 6,583,563 | B1 | 6/2003 | Venkataramani et al. | |
| 6,635,993 | B1 | 10/2003 | Niimi | |
| 6,642,654 | B2 | 11/2003 | Niimi | |
| 6,657,388 | B2 | 12/2003 | Wijenberg et al. | 313/623 |
| 6,750,612 | B2 | 6/2004 | Takagaki et al. | |
| 6,781,292 | B2 | 8/2004 | Ishida et al. | |
| 6,791,267 | B2 | 9/2004 | Niimi | |
| 6,812,642 | B1 | 11/2004 | Niimi | |
| 6,815,894 | B2 | 11/2004 | Takagaki et al. | |
| 6,873,109 | B2 | 3/2005 | Ishigami et al. | |
| 6,891,131 | B2 * | 5/2005 | Sakuma et al. | 219/390 |
| 2002/0027421 | A1 | 3/2002 | Kaneko et al. | |
| 2002/0117965 | A1 | 8/2002 | Kotter et al. | 313/573 |
| 2004/0108814 | A1 | 6/2004 | Tsuda et al. | |
| 2004/0119413 | A1 | 6/2004 | Kebbede et al. | |
| 2004/0119414 | A1 | 6/2004 | Kebbede et al. | |
| 2004/0124776 | A1 | 7/2004 | Iorio | |
| 2004/0135510 | A1 | 7/2004 | Bewlay et al. | |
| 2004/0174121 | A1 | 9/2004 | Tsuda et al. | |
| 2004/0183446 | A1 | 9/2004 | Grundmann et al. | |
| 2005/0007020 | A1 | 1/2005 | Tsuda et al. | |
| 2006/0001346 | A1 | 1/2006 | Vartuli et al. | |
| 2006/0008677 | A1 | 1/2006 | Bewlay et al. | |
| 2006/0012306 | A1 | 1/2006 | Bewlay et al. | |

FOREIGN PATENT DOCUMENTS

| | | |
|---|---|---|
| EP | 1150337 | 10/2001 |
| EP | 1158567 | 11/2001 |
| EP | 1172839 | 1/2002 |
| EP | 1172840 | 1/2002 |
| EP | 1220295 | 7/2002 |
| EP | 1253616 | 10/2002 |
| EP | 1296355 | 3/2003 |
| EP | 1351276 | 10/2003 |
| EP | 1363313 | 11/2003 |
| EP | 1434247 | 6/2004 |
| JP | 2004214194 | 7/2004 |
| WO | WO9825294 | 6/1998 |
| WO | WO03058674 | 7/2003 |
| WO | WO03099741 | 12/2003 |
| WO | WO2004023517 | 3/2004 |
| WO | WO2004049390 | 6/2004 |
| WO | WO2004049391 | 6/2004 |
| WO | WO2004051699 | 6/2004 |
| WO | WO2004051700 | 6/2004 |
| WO | WO2004102614 | 11/2004 |

OTHER PUBLICATIONS

U.S. Appl. No. 10/738,261, filed Dec. 17, 2003, Bewlay et al.

U.S. Appl. No. 10/984,593, filed Nov. 9, 2004, Loureiro et al.

U.S. Appl. No. 11/172,649, filed Jun. 30, 2005, Bewlay et al.

U.S. Appl. No. 11/172,650, filed Jun. 30, 2005, Bewlay et al.

U.S. Appl. No. 11/172,651, filed Jun. 30, 2005, Bewlay et al.

U.S. Appl. No. 11/289,128, filed Nov. 29, 2005, Bewlay et al.

Tokumatsu Tachiwaki et al., "*Novel Synthesis of $Y_3Al_5O_{12}$ (YAG) Leading to Transparent Ceramics*", Solid State Communications, vol. 119, pp. 603-606, 2001.

Lei Wen et al., "*Synthesis of Nanocrystalline Yttria Powder and Fabrication of Transparent YAG Ceramics*", Journal of the European Ceramic Society, vol. 24, pp. 2681-2688, 2003.

D. Hreniak et al., "*Synthesis and Optical Properties of $Nd^3$+–Doped $Y_3Al_5O_{12}$Nanoceramics*", Journal of Alloys and Compounds, vol. 341, pp. 183-186, 2002.

Guanshi Qin et al., "*Upconversion Luminescence of $Er^3$+In Highly Transparent YAG Ceramics*", Solid State Communications, vol. 132, pp. 103-106, 2004.

Jianren Lu et al., "*Neodymium Doped Yttrium Aluminum Garnet ($Y_3Al_5O_{12}$) Nanocrystalline Ceramics—A New Generation of Solid State Laser and Optical Materials*", Journal of Alloys and Compounds, vol. 341, pp. 220-225, 2002.

A.K. Pradhan et al., "*Synthesis of Neodymium-Doped Yttrium Aluminum Garnet (YAG) Nanocrystalline Powders Leading to Transparent Ceramics*", Materials Research Bulletin, vol. 39, pp. 1291-1298, 2004.

* cited by examiner

SYSTEM AND METHOD FOR SEALING HIGH INTENSITY DISCHARGE LAMPS

BACKGROUND

The invention relates generally to the field of lighting systems and, more particularly, to high-intensity discharge (HID) lamps. Specifically, embodiments of the present technique provide improved sealing features for such lamps.

High-intensity discharge lamps are often formed from a tubular body or arc tube that is sealed to one or more end structures. The tubular body may be made of any ceramic material, including polycrystalline alumina (PCA), sapphire, single crystal yttria aluminum garnet (YAG) and polycrystalline YAG. The end structures are often sealed to this ceramic tubular body using a seal glass, which has physical and mechanical properties matching those of the ceramic components and the end structures. Sealing usually involves heating the assembly of the ceramic tubular body, the end structures and the seal glass, to induce melting of the seal glass and a reaction with the ceramic bodies to form a strong chemical and physical bond. The ceramic tubular body and the end structures are often made of the same material. However, certain applications may require the use of different materials for the ceramic tubular body and the end structures. In either case, various stresses may arise due to the sealing process, the interface between the joined components, and the materials used for the different components. For example, the component materials may have different mechanical and physical properties, such as different coefficients of thermal expansion (CTE), which can lead to residual stresses and sealing cracks. These potential stresses and sealing cracks are particularly problematic for high-pressure lamps.

Additionally, the geometry of the interface between the ceramic tubular body and the end structures also may attribute to the foregoing stresses. For example, the end structures are often shaped as a plug or a pocket, which interfaces both the flat and cylindrical surfaces of the ceramic tubular body. If the components have different coefficients of thermal expansion and elastic properties, then residual stresses arise because of the different strains that prevent relaxation of the materials to stress-free states. For example in the case of the plug type end structure, if the plug has a lower coefficient of thermal expansion than the ceramic tubular body and seal glass, then compressive stresses arise in the ceramic-seal glass region while tensile stresses arise in the plug region.

Typically, the seal glasses used for sealing ceramic lamp components are required to be non-reactive with the different species in the lamp environment and to possess microstructural stability during the life of the lamp, in addition to having a melting temperature and a crystallization temperature above the lamp operating temperature. However, for high temperature lamp applications, these are challenging requirements.

In sealing techniques used currently, the seal glass is generally melted using a furnace cycle, such as a large muffle type furnace, with temperatures up to 1750 degrees centigrade. The seal glass and the ceramic components to be sealed are inserted into a base of the furnace and the furnace is operated through a controlled temperature cycle. The controlled temperature cycle is designed in conjunction with a temperature gradient at the end of the furnace to melt the seal glass (typically a dysprosia-alumina-silica mixture), which then flows through the gap between components to be sealed. The seal length is controlled in part by the temperature gradient.

The above approach may be disadvantageous in several respects. Firstly, the furnace used in the above described technique provides a relatively diffuse heat source with a low temperature gradient. Hence, the technique does not provide a desired control of seal length and seal microstructure. Further, the above technique may not be useful for a wide variety of lamp geometries. For example, in lamps having a short aspect ratio (i.e., ratio of length to diameter), an important consideration while sealing an end of the lamp is to preserve the dosing material inside the lamp. The above technique may prove disadvantageous in such applications, as the diffuse heat produced by the furnace may result in undesirable heating of the dosing material during sealing of one end of the lamp.

Accordingly, a technique is needed to provide a lighting system with improved sealing characteristics for sealing a wide variety of ceramic lamp components having varied geometries.

BRIEF DESCRIPTION

The present technique provides novel sealing systems and methods designed to respond to such needs. In one aspect, the present technique provides a system for sealing a lamp. The system includes a thermal shield and a thermally susceptible enclosure disposed adjacent the thermal shield. The thermal shield has a first receptacle adapted to receive a first portion of the lamp. The thermally susceptible enclosure includes a wall about a second receptacle adapted to receive a second portion of the lamp. The wall has a varying thickness in a desired sealing region between the first and second portions of the lamp.

In another aspect, the present technique provides a method of sealing a lamp. In accordance with an embodiment of this sealing method, a first portion of the lamp is thermally shielded. In addition, a second portion of the lamp is thermally susceptibly surrounded with a variable geometry along a desired sealing region between the first and second portions, the variable geometry being adapted to provide a variable heat susceptibility along the desired sealing region. The desired sealing region is hermetically enclosed. Heat is transferred radiatively through the variable geometry and into the desired sealing region with a variable heat profile based on the variable heat susceptibility. In yet another aspect, the present technique provides a lamp which is sealed by the above method.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Aspects of the present technique provide unique sealing systems and methods for sealing between a wide variety of lamp components at high temperatures, for example, by providing localized heating and a high temperature gradient in the sealing region. Localized heating and a high temperature gradient minimize thermal stress in the components being sealed and substantially reduce or prevent cracking during heat-up, sealing, and cool-down stages of the sealing operation. Moreover, localized heating also aids retention of a lamp dose during the sealing operation. A high temperature gradient provides desirable microstructure control for both crystalline and glass phases of the seal. The unique features introduced above are described with respect to several exemplary embodiments of the present technique illustrated hereinafter.

Figure 1:
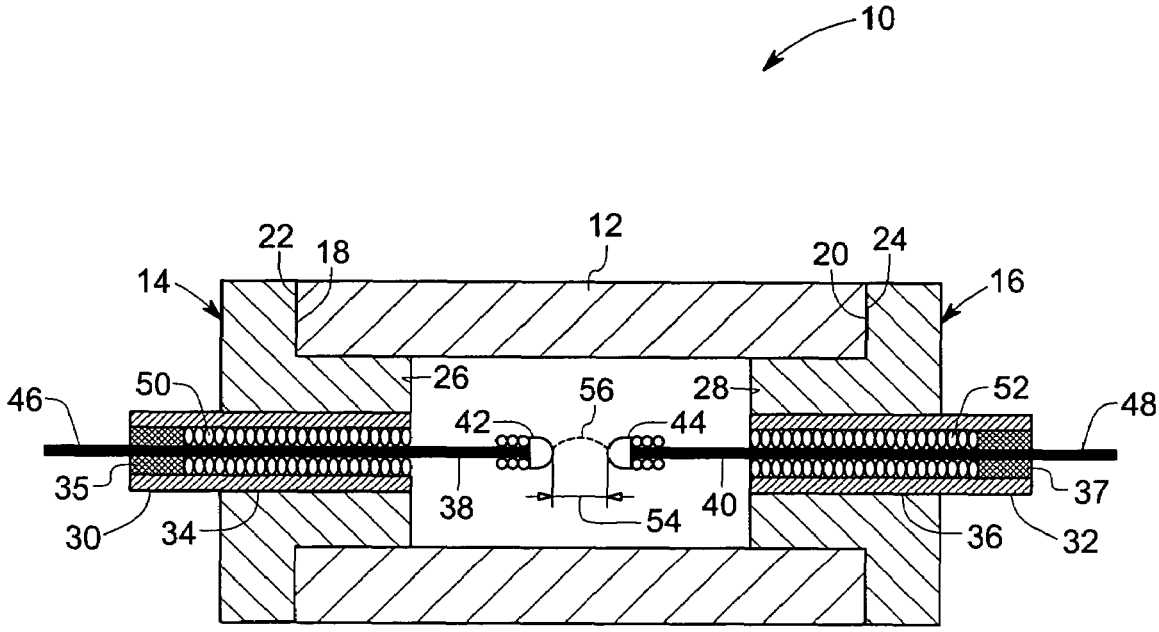
FIG. 1 is a cross-sectional view of an exemplary lamp wherein embodiments of the present technique are applicable.

Turning now to the drawings, FIG. 1 is a cross sectional view of an exemplary lamp 10 wherein aspects of the present technique are applicable. As illustrated, the lamp 10 comprises a hermetically sealed assembly of a hollow body or arc envelope 12 and end structures 14 and 16 coupled to opposite ends 18 and 20 of the arc envelope 12, respectively. These and other components of the lamp 10 are formed from a variety of materials, which are either identical or different from one another. For example, different embodiments of the arc envelope 12 are formed from a variety of transparent ceramics and other materials, such as yttrium-aluminum-garnet (YAG), ytterbium-aluminum-garnet, microgram polycrystalline alumina (μPCA), alumina or single crystal sapphire, yttria, spinel, and ytterbia. Other embodiments of the arc envelope 12 are formed from conventional lamp materials, such as polycrystalline alumina (PCA). Turning to the end structures 14 and 16 of the lamp 10, these components are formed from a variety of ceramics and other suitable materials, such as niobium, niobium coated with a corrosion resistant material (e.g., a halide resistant material), a cermet (e.g., an alumina-molybdenum cermet, an alumina-tungsten cermet, etc.), and other conductive or non-conductive materials depending on the particular embodiment described in detail below.

Regarding the geometry of the lamp 10, certain embodiments of the arc envelope 12 comprise a hollow cylinder, a hollow oval shape, a hollow sphere, a bulb shape, a rectangular shaped tube, or another suitable hollow transparent body. Moreover, the end structures 14 and 16 may have a variety of geometries. In the illustrated embodiment the end structures 14 and 16 have a plug-shaped geometry that at least partially extends into the arc envelope 12. Alternatively, some embodiments of the end structures may have a substantially flat mating surface, which butt-seals against the opposite ends 18 and 20 (i.e., end-to-end) without extending into the arc envelope 12. The illustrated end structures 14 and 16 comprise outer seal structures 22 and 24 and inner seal structures 26 and 28. The outer seal structures 22 and 24 of the end structure 14 and 16 abut and seal against the opposite ends 18 and 20 of the arc envelope 12. The inner seal structures 26 and 28 plug into the opposite ends 18 and 20 and seal with inner surfaces of the arc envelope 12 adjacent the opposite ends 18 and 20.

The lamp 10 is filled with a dosing material through one or more dosing tubes 30 and 32. The dosing tubes 30 and 32 are disposed within dosing passageways 34 and 36 extending through the end structures 16 and 18. In certain embodiments, these dosing tubes 30 and 32 are diffusion bonded or co-sintered to the end structures 16 and 18 within the dosing passageways 34 and 36. Alternatively, embodiments of the dosing tubes 30 and 32 are bonded within the dosing passageways 34 and 36 using a sealing material, such as sealing materials 35 and 37, respectively. Regarding the material composition, the dosing tubes 30 and 32 may comprise ceramics, such as alumina, sapphire, YAG, yttria, amongst others. As a result, dosing tubes 30 and 32 made of ceramics such as those mentioned above may be diffusion bonded to end structures 16 and 18 made of ceramics such as alumina, sapphire, YAG, etc. Alternatively, certain embodiments of the dosing tubes 30 and 32 may be formed of metals, such as niobium, molybdenum, amongst others. Inside the lamp 10, certain embodiments of the dosing material include a rare gas and mercury. Other embodiments of the dosing material further comprise a halide, such as bromine, or a rare-earth metal halide.

The lamp 10 also includes arc electrodes 38 and 40 having arc tips 42 and 44, respectively. Leading into the arc envelope 12, the lamp 10 includes electrode lead wires 46 and 48, which extend through the dosing tubes 30 and are in physical contact with the arc electrodes 38 and 40, respectively. In alternate embodiments, one or more of the arc electrodes 38 or 40 may be mounted in receptacles (not shown) disposed in respective end structures 14 and 16. In certain embodiments, the electrodes 38 and 40 may be inserted in support structures 50 and 52, such as a coils, which are then mounted inside the dosing tubes 22 and 24. The coils 50 and 52 support the arc electrodes 38 and 40 within the dosing tubes 30 and 32, while also permitting some freedom of movement and stress relaxation of the respective components. The arc electrodes 38 and 40 are mounted such that the arc tips 42 and 44 are separated by a gap 54 to create an arc 56 during the operation of the lamp 10. In certain embodiments, the lead wires 46 and 48 are formed from niobium and welded to the electrodes 38 and 40, which are formed from molybdenum and are, in turn, welded to the arc tips 42 and 44 formed from tungsten. In a different embodiment, both lead wires and electrodes may be formed from molybdenum. Other embodiments of the electrodes 38 and 40, the arc tips 42 and 44, and the lead wires 46 and 48 comprise a variety of other suitable materials, including cermets, such as tungsten cermet, molybdenum cermet, or metals, such as tantalum, rhenium, amongst others.

Embodiments of the lamp 10 also have a variety of different lamp configurations and types, such as a high intensity discharge (HID) or an ultra high intensity discharge (UHID) lamp. For example, certain embodiments of the lamp 10 comprise a high-pressure sodium (HPS) lamp, a ceramic metal halide (CMH) lamp, a short arc lamp, a ceramic automotive lamp, an ultra high pressure (UHP) lamp, or a projector lamp. As mentioned above, components of the lamp 10 are uniquely sealed in accordance with aspects of the present technique described hereinafter. In certain embodiments of the present technique, a seal material, also referred to as frit or seal glass, is used between interfacing surfaces of the components to be sealed. The choice of the seal material is dependent on the configuration of the lamp, the operating temperatures and material compositions of the components to be sealed. Accordingly, depending upon the particular application, the seal material may comprise a wide variety of rare-earth oxide based seals such as yttrium aluminum silica (YAS) glass, dysprosia alumina silica seals, amongst others. In alternative embodiments, components having similar composition may be sealed via diffusion bonding of the materials at the interfacing surfaces of the components.

Figure 2:
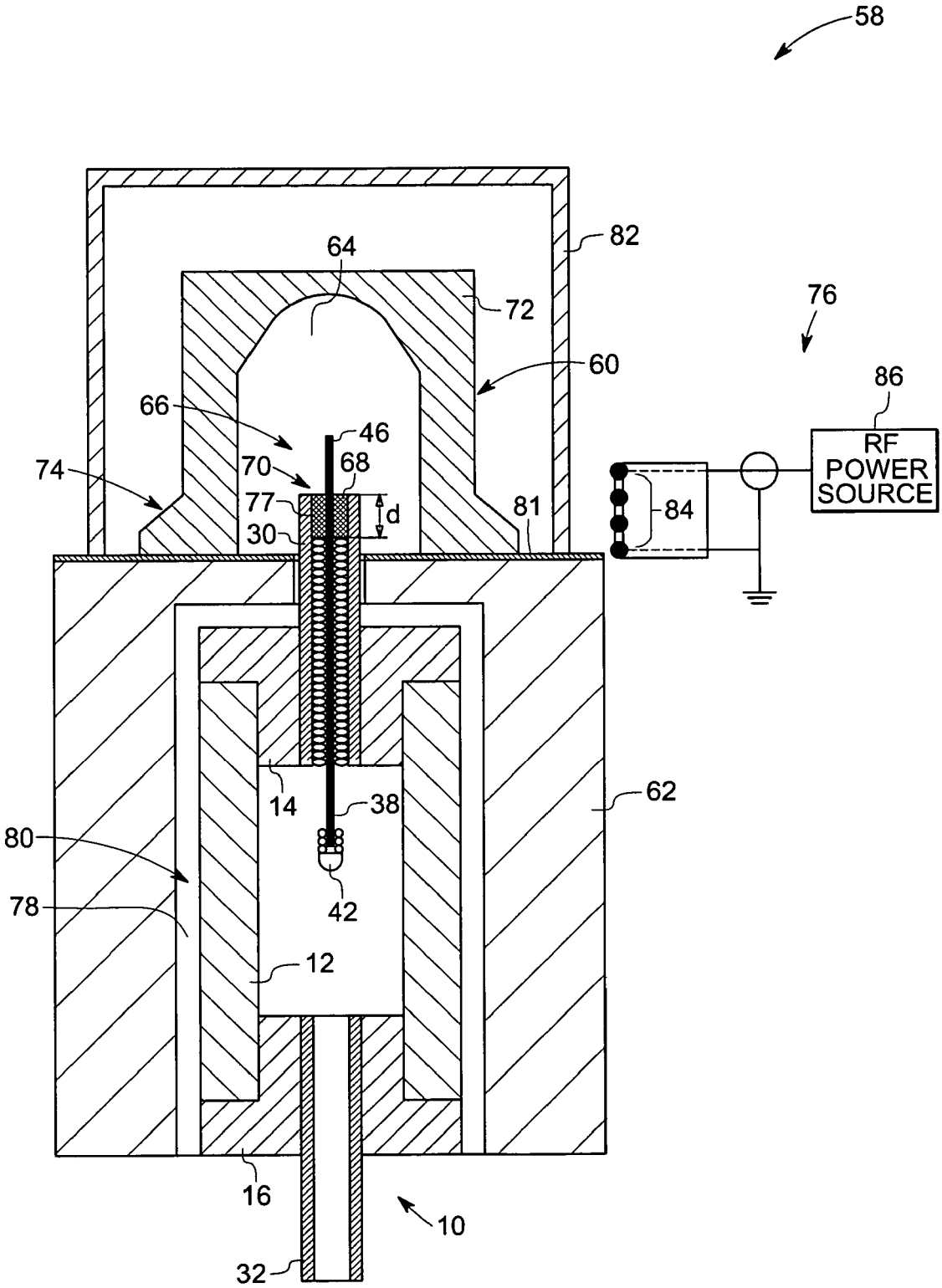
FIG. 2 is a cross-sectional view of a system for sealing a lead wire to a dosing tube of the lamp using a radiative heat source having a pancake-shaped configuration that heats a susceptor having a varying wall thickness according to one embodiment of the present technique.

FIG. 2 illustrates a cross sectional view of an exemplary system 58 for sealing the electrode lead wire 46 of the lamp 10 to the dosing tube 30, also referred to as a leg portion of the lamp 10, in accordance with embodiments of the present technique. The system 58 includes a thermally susceptible enclosure 60 disposed on a base 62. The thermally susceptible enclosure 60 has a receptacle 64 to receive a portion 66 of the lamp 10 including the electrode lead wire 46. In the illustrated embodiment, a sealing material 68, also referred to hereinafter as frit, is suitably shaped and positioned in a desired sealing region 70 between the lead wire 46 and the dosing tube 30. In the illustrated embodiment, the thermally susceptible enclosure 60 includes a hollow thermal susceptor having a wall 72 surrounding the portion 66 of the lamp 10 including the lead wire 46. In one embodiment, the thermally susceptible enclosure 60 is formed from graphite. In alternative embodiments, the thermally susceptible enclosure 60 may be formed of metals such as tungsten, molybdenum, tantalum, rhenium, or other suitable materials that are susceptible to heating by electromagnetic radiation, a laser beam, and so forth.

In the desired sealing region 70, the wall 72 has a varying thickness 74 to control the heat profile or temperature gradient in the sealing region 70, as discussed in further detail below. For example, the varying thickness 74 may have a linearly changing geometry, a curved geometry (e.g., concave, convex, exponential, etc.), a stepped geometry, or any other suitable geometry. As illustrated, a radiative heat source 76 emits heat or generally radiatively heats up the thermally susceptible enclosure 60, which then radiates heat into the sealing region 70 with a desired temperature gradient or heat profile based on the varying thickness 74 of the wall 72. For example, embodiments of the heat source 76 include an induction heating device, a laser, a resistance heating device, or a suitable device that radiates an emission that causes heating of the thermally susceptible enclosure 60. In operation, the thermally susceptible enclosure 60 acts as a thermal collection and distribution device, which becomes heated by emissions from the radiative heat source 76 and then focuses the heat according to the varying thickness 74. The heat radiated by the thermally susceptible enclosure 60 melts the frit 68, which flows down through an annular gap 77 between the lead wire 46 and the dosing tube 30 to a depth (d), also referred to as seal length. In certain embodiments, sealing between the lead wire 46 and the dosing tube 30 may be achieved by material diffusion without any sealing material. In such embodiments, the heat radiated by the thermally susceptible enclosure 60 facilitates diffusion bonding of the materials at the interfacing surfaces of the lead wire 46 and the dosing tube 30 to produce a hermetical seal between one another.

The heat radiated by the thermally susceptible enclosure 60 has a varying profile in the sealing region 70 caused by the varying thickness 74 of the susceptor wall 72 in the sealing region 70. In the illustrated embodiment, the thickness of the susceptor wall 72 increases with depth (d) in the sealing region 70. Because of this varying thickness, a greater amount of heat is coupled to the lower portion of the variable geometry than the upper portion when the susceptor is heated by the radiative heat source 76, thereby causing the thermally susceptible enclosure 60 to radiate more heat to the lower portion of the sealing region 70 than to the upper portion of the sealing region 70. This variance establishes a high temperature gradient in the sealing region 70, which aids in controlling the depth (d) of the seal. More specifically, the temperature gradient thus produced results in a low temperature near the base 62, a high temperature in the sealing region 70 adjacent the thick part of the variable geometry, and a relatively lower temperature at the upper portion of the sealing region 70, thereby preventing melting of the lead wire 46. In certain embodiments where the lead wire 46 is formed from niobium, the depth (d) is controlled so as to cover the entire length of the niobium lead wire since niobium is reactive with certain dosing materials disposed inside the lamp 10. Further, the high temperature gradient facilitates high sealing temperatures close to the melting point of the seal material 68 and provides desirable microstructure control of the crystalline and glass phases of the seal 68. The temperature gradient may be measured via an optical pyrometer, a thermal imaging camera, a thermocouple system, and other methods of temperature measurement (such as paints, etc).

In cooperation with this localized temperature gradient in the sealing region 70, the base 62 reduces undesirable heating in the adjacent components of the lamp 10. In the illustrated embodiment, the base 62 includes a receptacle 78 to house a portion 80 of the lamp 10 including the dosing tube 30. The base 62 is adapted to thermally shield or cool the portion 80 of the lamp 10 during the sealing process. This shielding or cooling substantially restricts or further localizes the high temperature to the sealing region 70, rather than the adjacent portion 80 of the lamp 10. This thermal shielding or cooling also reduces thermal stress in the arc envelope 12 and other components, and prevents formation of cracks therein. Further, the localized high temperature gradient, thus established, reduces heating of the dosing substance disposed within the lamp 10. In certain embodiments, the base 62 is formed from a thermally conductive material including copper, copper alloys, molybdenum, tungsten, copper-tungsten alloys, graphite, among others, or combinations thereof. In these embodiments, the base 62 functions to transfer heat away from the portion 80 of the lamp 10. The base 62 also may comprise a variety of cooling mechanisms, such as heat sinks, heat pipes, fans, circulating fluids, and so forth. Certain embodiments of the system 58 may include a thermally insulating layer 81 between the thermally susceptible enclosure 60 and the base 62. The thermally insulating layer 81 substantially blocks heat transfer or radiative heat-generating emissions from the thermally susceptible enclosure 60 into the base 62 and the portion 80 disposed therein. The thermally insulating layer 81 may comprise an air gap, radiation shields, or thermally insulating materials, such as alumina, yttria, yttria stabilized zirconia, amongst other materials.

In addition to the thermally susceptible enclosure 60 and the base 62, the system 58 is hermetically sealed by an outer enclosure 82 surrounding the thermally susceptible enclosure 60 and disposed over the base 62. The system 58 may include a variety of sealing mechanisms, such as gaskets, O-rings, amongst others. In certain embodiments, the outer enclosure 82 is formed from a material including quartz, glass, Pyrex, steel, stainless steel, aluminum, copper, among others, or combinations thereof. The outer enclosure 82 may be filled with an inert gas, such as xenon, crypton, argon, among others, such that the sealing region 70 is surrounded by the inert gas. In this manner, the inert gas prevents undesirable oxidation of metallic lead wire components, metallic furnace components such as the susceptor, and so forth. Alternatively, the system 58 may create a vacuum inside the hermetically sealed outer enclosure 82. In this manner, the outer enclosure 82 facilitates an air-tight seal for the system 58.

In the illustrated embodiment, the heat source 76 includes a radio frequency (RF) induction coil 84 coupled to a source 86 of radio frequency (RF) power. The RF induction coil 84 is energized by passing an alternating current (AC) through the induction coil 84 via the power source 86. In one embodiment, the alternating current has a frequency of 250 KHz. The choice of frequency of the alternating current depends upon the design of the thermally susceptible enclosure 60. In certain embodiments, the frequency may range from about 50 Hz to about 2 MHz. The alternating current generates an electromagnetic field, which induces a current in the thermally susceptible enclosure 60. The thermally susceptible enclosure 60 is heated in the process and radiates heat to the sealing region 70 as described above.

The power source 86 may be controlled to establish a desired sealing temperature. In one embodiment, the sealing temperature is 1875 degrees centigrade. In certain embodiments of the present technique, the sealing temperature may range from about 1000 degrees centigrade to about 1950 degrees centigrade. The power source 86 may also be controlled to provide a desired time profile of the heating cycle. In one embodiment, the sealing temperature is maintained at 1475 degrees centigrade for approximately one minute of operation. The sealing temperature is then raised from 1475 degrees centigrade to 1875 degrees centigrade over a period of approximately 40 seconds, and is then maintained at 1875 degrees centigrade for about 30 seconds. The sealing region 70 is subsequently cooled or quenched to produce a hermetical seal between the lead wire 46 and the dosing tube 30. The rate of quenching is dependent on the particular components being sealed and the particular sealing material used, if any.

Figure 3:
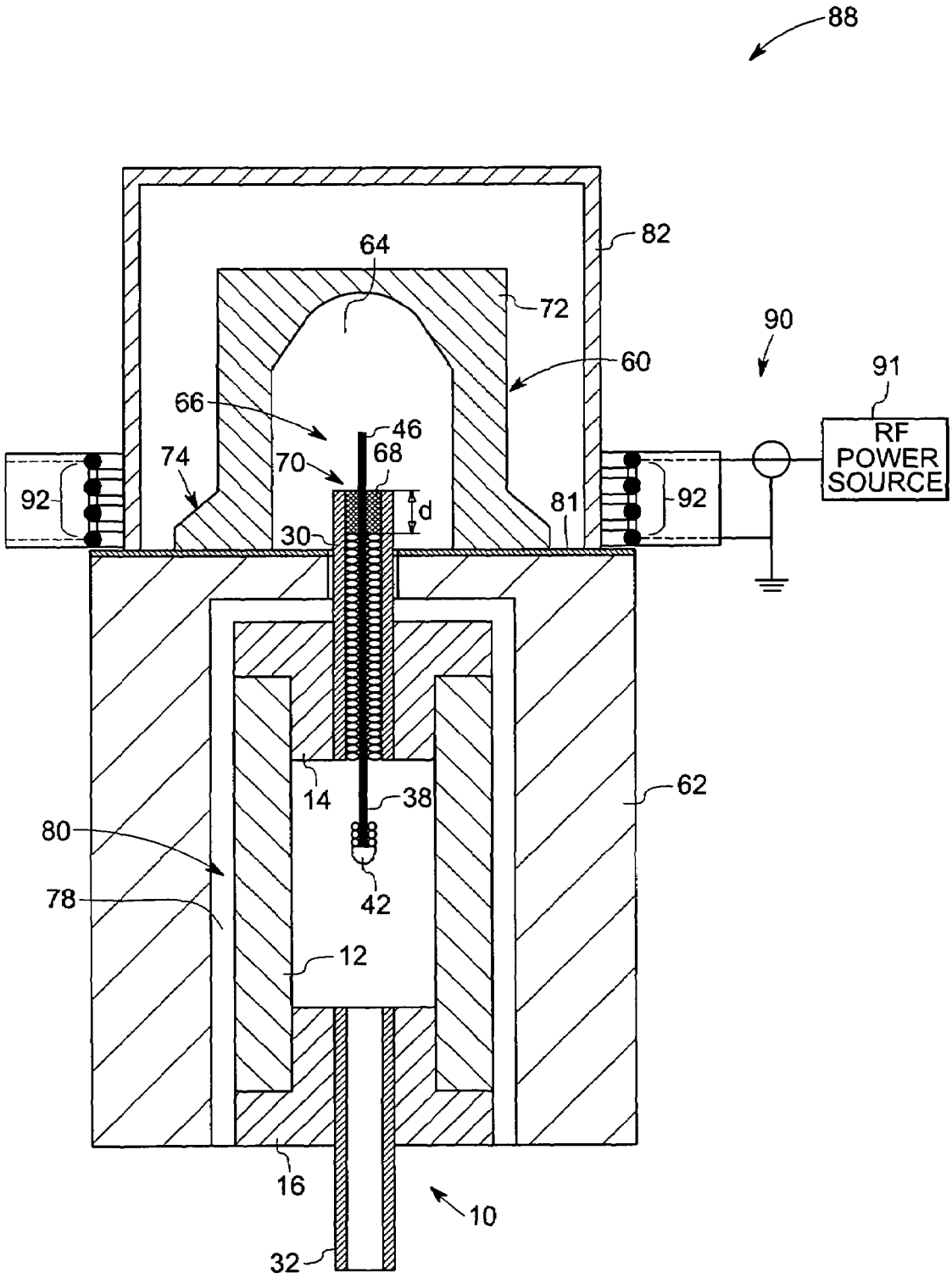
FIG. 3 is a cross-sectional view of a system for sealing a lead wire to a dosing tube of the lamp using a radiative heat source having an annular configuration that heats a susceptor having a varying wall thickness according to another embodiment of the present technique.

In the embodiment illustrated in FIG. 2, the induction coil 84 has a pancake configuration and is positioned aside the sealing region 70 outside the outer enclosure 82. Alternatively, FIG. 3 illustrates a system 88 having a radiative heat source 90 including a power source 91 coupled to an induction coil or solenoid coil 92 that annularly encircles the sealing region 70. However, the coils may have a variety of configurations and features in accordance with embodiments of the present technique.

Figure 4:
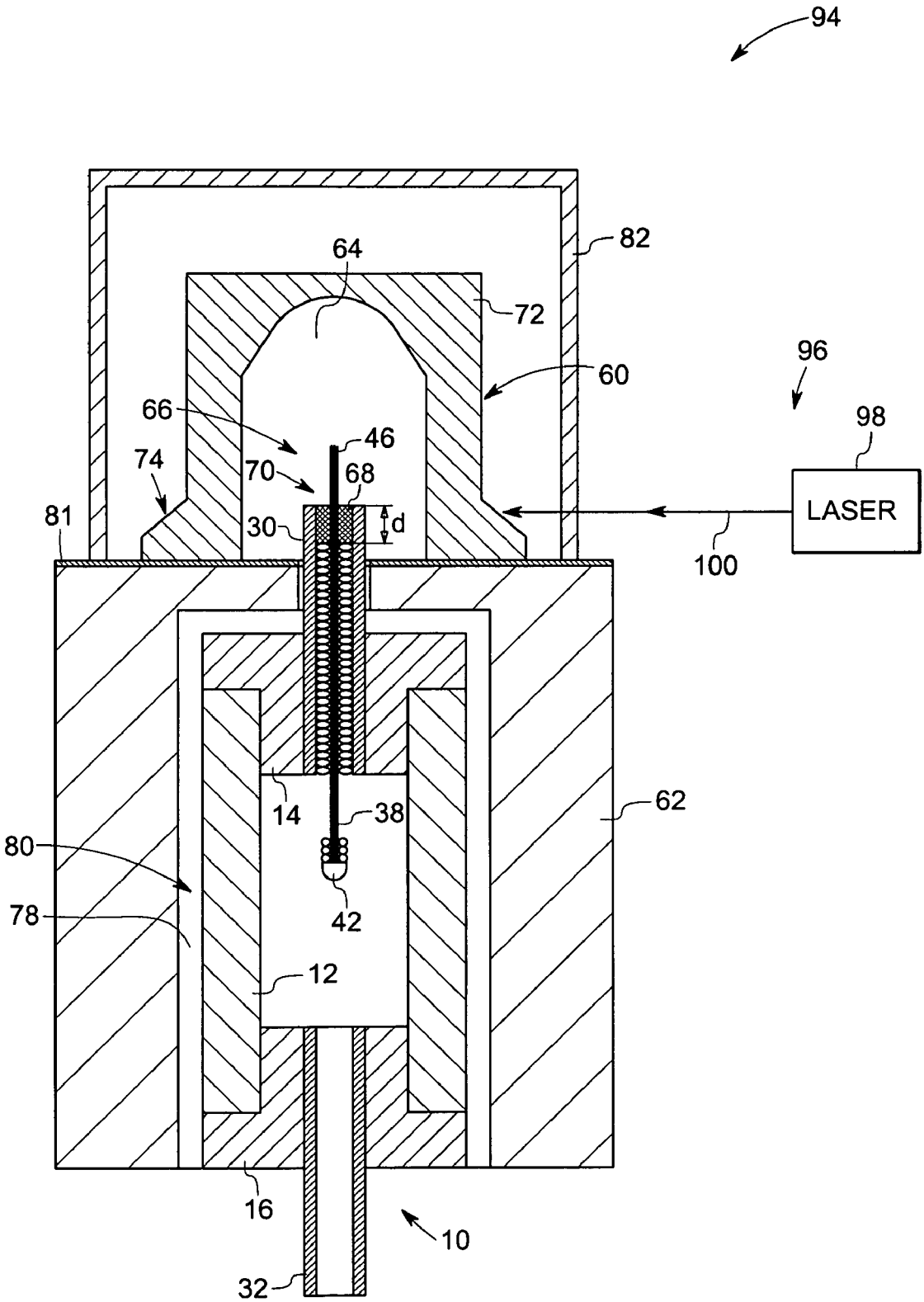
FIG. 4 is a cross-sectional view of a system for sealing a lead wire to a dosing tube of the lamp using a laser that heats a susceptor having a varying wall thickness according to yet another embodiment of the present technique.

It should be appreciated that other radiative heat sources that provide local heating of the sealing region 70 are also within the scope of the present technique. For example, FIG. 4 illustrates a system 94 having a radiative heat source 96 that includes a laser 98. The laser 98 is operable to produce a beam 100, which may be focused onto the thermally susceptible enclosure 60 in the sealing region 70. The thermally susceptible enclosure 60 absorbs the energy of the laser beam 100, and radiates heat to the desired sealing region 70.

Figure 5:
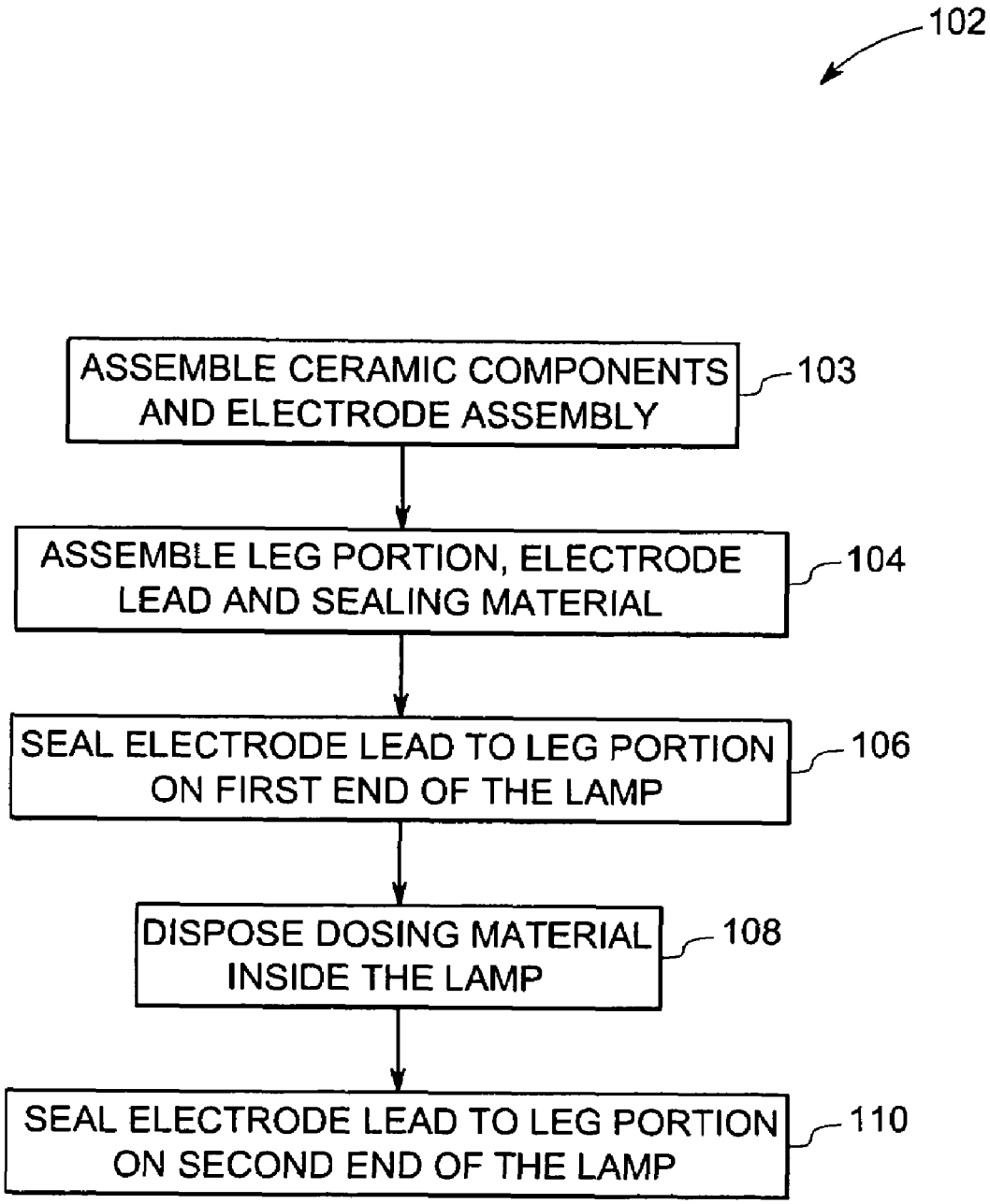
FIG. 5 is a flow chart illustrating an exemplary seal process flow according to embodiments of the present technique.

FIG. 5 is a flow chart illustrating an exemplary sealing process for the lamp 10 in accordance with embodiments of the present technique. The sealing process 102 begins by assembling ceramic components of the lamp such as the arc envelope, ends structures, and dosing tubes (block 103). Block 103 may also include assembling an electrode assembly comprising the electrode tip, the arc electrode, and the electrode lead. At block 104, the process 102 continues by assembling the electrode lead, the ceramic leg portion or the dosing tube, and the sealing material. One end of the lamp is then sealed (block 106). Block 106 includes sealing the electrode lead wire 46 to the dosing tube 30 as described above. Specifically, block 106 includes heating up a susceptor having a varying wall thickness, which then radiates heat with a desired heat profile toward the components being sealed. The block 106 may also include cooling or quenching of the sealing region. The lamp is then filled with a dosing material such as any of those mentioned above (block 108). At block 110, the other end of the lamp 10 is sealed. This may include sealing the electrode lead wire 48 to the dosing tube 32 in a similar manner as described above for sealing the electrode lead wire 46 to the dosing tube 30. Again, the block 110 may include heating a susceptor having a varying wall thickness, which then radiates heat with a desired heat profile toward the components being sealed. The sealing region on the other end may be subsequently cooled or quenched.

Figure 6:
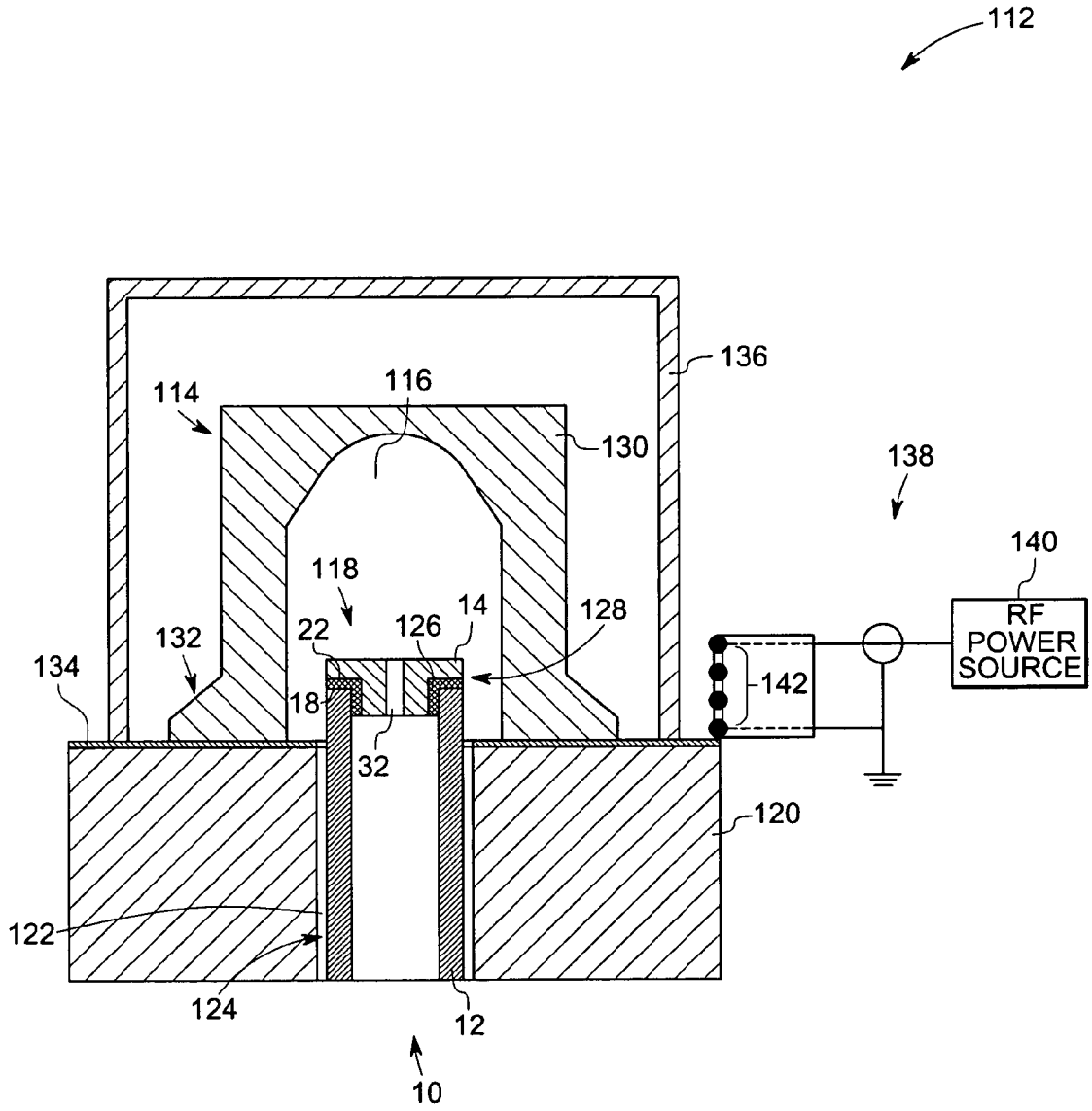
FIG. 6 is a cross-sectional view of a system for sealing an end structure to an arc envelope of the lamp using a radiative heat source that heats a susceptor having a varying wall thickness according to embodiments of the present technique.

As discussed above, various embodiments of the present technique can be employed to seal a wide variety of lamp components. For example, an embodiment of the present technique can be used to seal an end structure to an arc envelope. Referring now to FIG. 6, a system 112 is illustrated for sealing the end structure 14 of the lamp 10 to the arc envelope 12. The system 112 includes a hollow susceptor 114 having a receptacle 116 to receive a portion 118 of the lamp 10 including the end structure 14. The susceptor 114 is disposed on a base 120 having a receptacle 122 to receive another portion 124 of the lamp 10 including the arc envelope 12. A frit 126 is suitably disposed in a sealing region 128 between the end structure 14 and the arc envelope 12. As described above, in certain embodiments, no sealing material is disposed between the end structure 14 and the arc envelope 12 and sealing between them is achieved by diffusion bonding. Similar to the earlier embodiment, the susceptor 114 has a wall 130, which has a varying thickness 132 in the sealing region 128. For example, the varying thickness 132 may have a linearly changing geometry, a curved geometry (e.g., concave, convex, exponential, etc.), a stepped geometry, or any other suitable geometry. The system 112 may include a thermally insulating layer 134 as described earlier, to block heat transfer or radiative heat-generating emissions from the susceptor 114 into the base 120 and the portion 124 disposed therein. The system 112 is further hermetically sealed by an outer enclosure 136, which may be internally in vacuum or filled with an inert gas in certain embodiments. A radiative heat source 138 is provided to radiate heat or heat-generating emissions to the susceptor 114. In turn, the heated susceptor 114 radiates heat toward the sealing region 128, thereby creating a varying heat profile to melt the frit 126 or to facilitate material diffusion at the interfacing surfaces of the end structure 14 and the arc envelope 12. As described above, the heat radiated by the susceptor 114 has a varying profile in the sealing region 128 to provide a high temperature gradient in the sealing region 128, thereby controlling the depth and other characteristics of the seal. In the illustrated embodiment, the heat source 138 includes a radio frequency power source 140 coupled to an induction coil 142 having a pancake configuration. However, as described above, the radiative heat source 138 may have several alternative embodiments.

Figure 7:
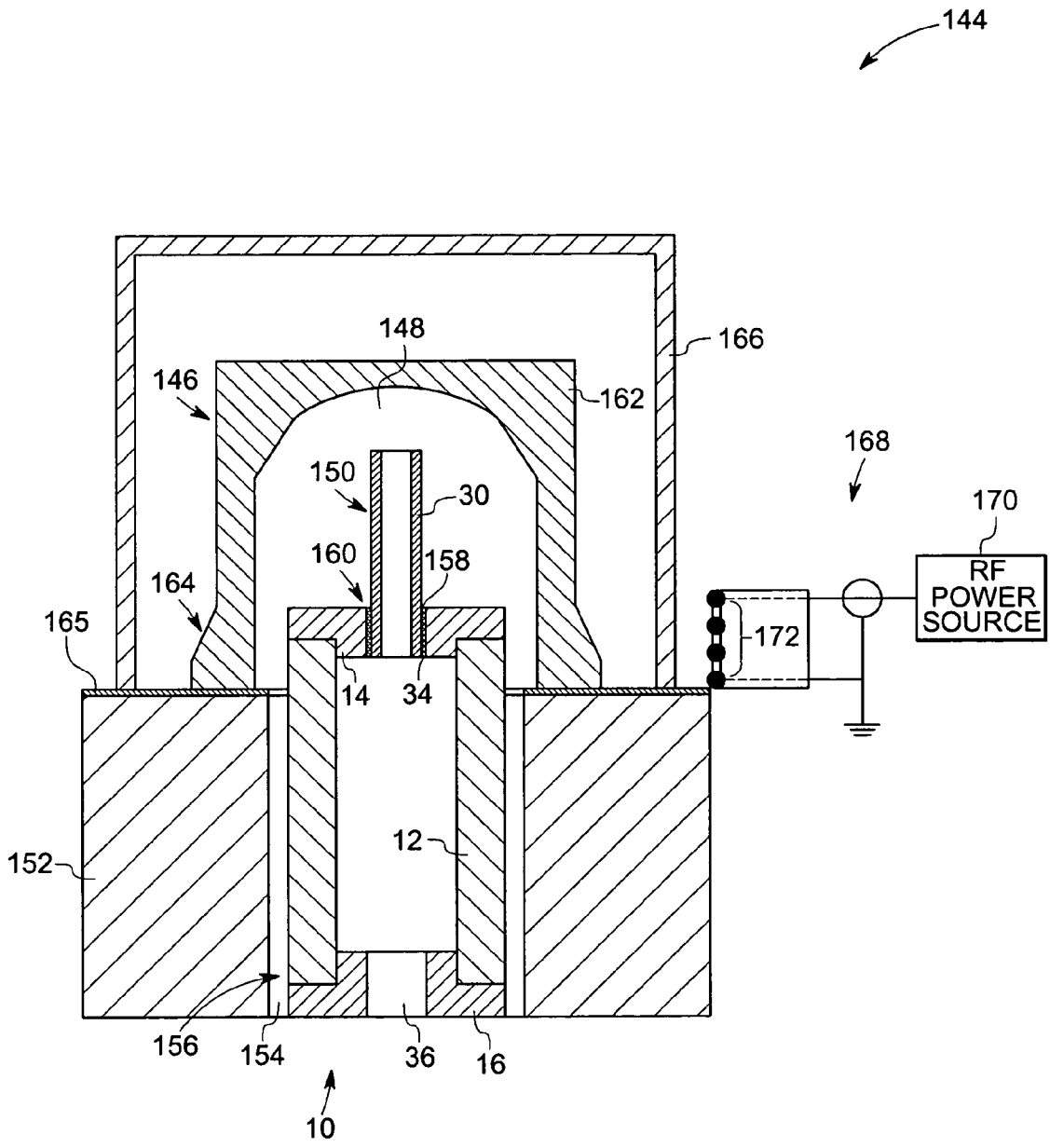
FIG. 7 is a cross-sectional view of a system for sealing an dosing tube to an end structure of the lamp using a radiative heat source that heats a susceptor having a varying wall thickness according to embodiments of the present technique.

According to a further embodiment, the present technique can be employed to seal a dosing tube or a leg portion to an end structure. FIG. 7 illustrates a system 144 for sealing the dosing tube 30 to the end structure 14. The system 144 includes a hollow thermal susceptor 146 having a receptacle 148 to receive a portion 150 of the lamp 10 including the dosing tube 30. A base 152 is disposed adjacent the susceptor 146 and has a receptacle 154 to receive another portion 156 of the lamp 10 including the end structure 14. A frit 158 is suitably disposed in a sealing region 160 between the end structure 14 and the dosing tube 30. Alternatively, the dosing tube 30 may be sealed to the end structure 14 by diffusion bonding without the use of the frit or sealing material 158. The wall 162 of the susceptor 146 has a varying thickness 164 in the sealing region 160. For example, the varying thickness 164 may have a linearly changing geometry, a curved geometry (e.g., concave, convex, exponential, etc.), a stepped geometry, or any other suitable geometry. The system 144 may include a thermally insulating layer 165 as described earlier, to block heat transfer or radiative heat-generating emissions from the susceptor 146 into the base 152 and the portion 156 disposed therein. The system 144 is hermetically sealed by an outer enclosure 166, which may be internally in vacuum or filled with an inert gas in certain embodiments. Heat or a heat-generating emission is radiated by a radiative heat source 168 to the susceptor 146, which in turn radiates heat with a varying heat profile into the sealing region 160. As a result, the varying heat profile melts the frit 158 or to facilitate material diffusion at the interfacing surfaces of the dosing tube 30 and the end structure 14 in the sealing region 160, thereby producing a hermetical seal between the end structure 14 and the dosing tube 30. As described above, the heat radiated by the susceptor 146 has a varying profile in the sealing region 160 to provide a high temperature gradient in the sealing region 160, thereby controlling the depth and other characteristics of the seal. Again, the illustrated embodiment of the heat source 168 includes a radio frequency power source 170 coupled to an induction coil 172 having a pancake configuration. However, several different embodiments of the radiative heat source 168 are within the scope of the present technique.

Figure 8:
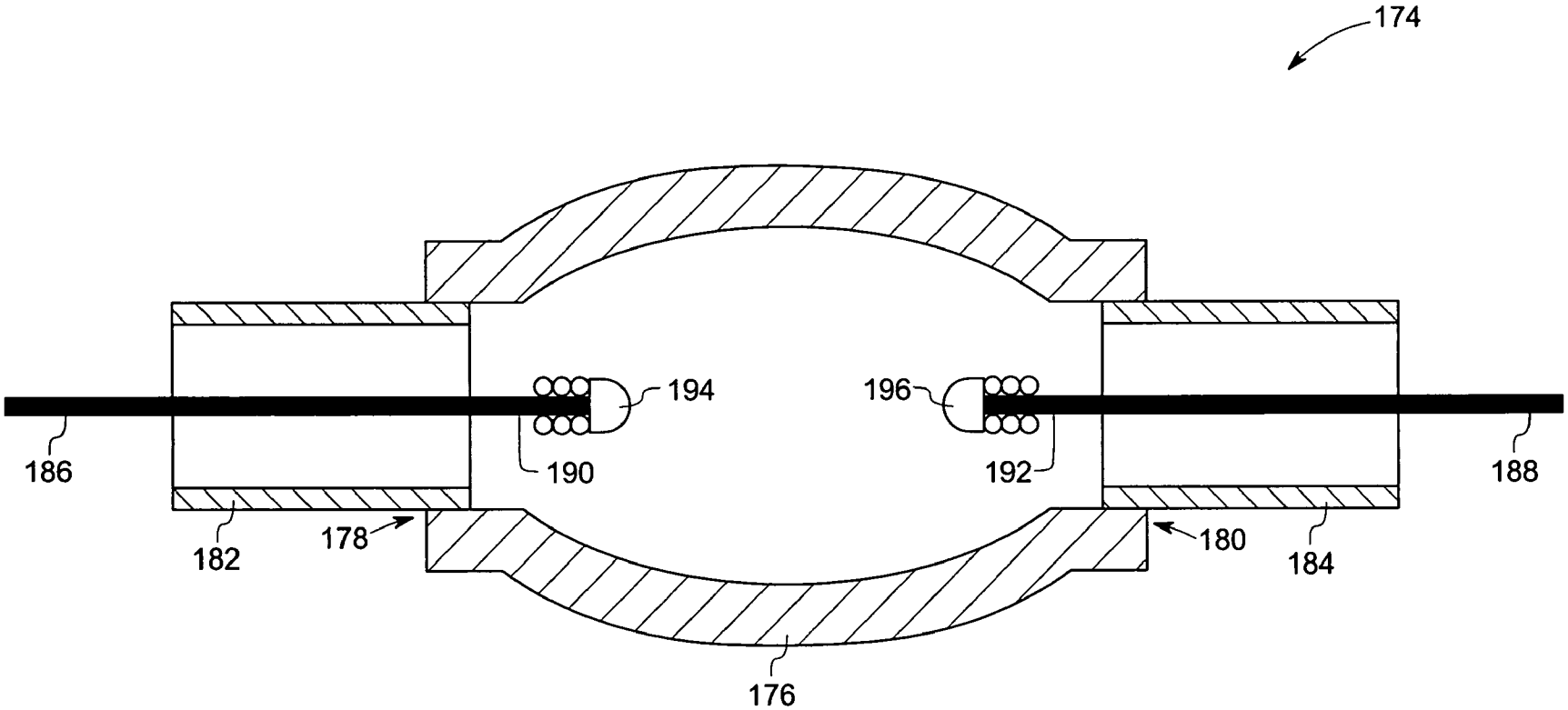
FIG. 8 is a cross-sectional view of another exemplary lamp wherein embodiments of the present technique are applicable.

In certain embodiments, the dosing tube and/or the electrodes are coupled directly into the arc envelope. Embodiments of the present technique can be used to seal the dosing tube to the arc envelope in such lamps. FIG. 8 illustrates a cross-sectional view of an exemplary lamp 174 as described above wherein aspects of the present technique are applicable. The lamp 174 has a hollow body or arc envelope 176 which has opposite receptacles or open ends 178 and 180, e.g., integral open end structures. In the illustrated embodiment, the arc envelope has a generally curved or round geometry. In certain embodiments, the arc envelope 176 has an elliptical, oval, spherical, oblong, bulb-shaped, dome-shaped, tubular, or other desired geometry. Dosing tubes 182 and 184 are fitted into the open ends 178 and 180. Additionally, lead wires 186 and 188 extend through the dosing tubes 182 and 184 to the arc envelope 176. In turn, the lead wires 186 and 188 extend to arc electrodes 190 and 192 having tips 194 and 196 disposed within the arc envelope 176.

Figure 9:
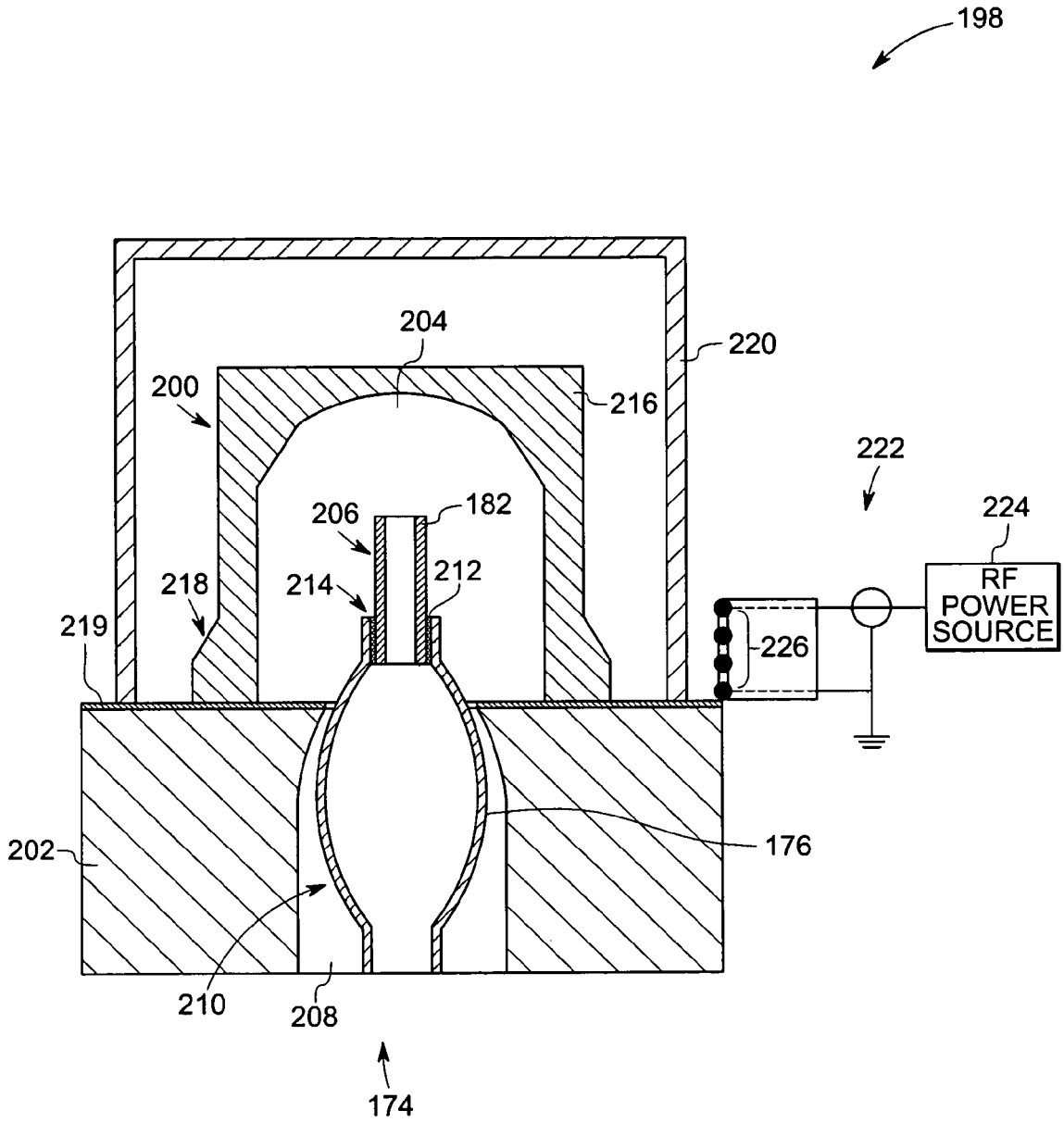
FIG. 9 is a cross-sectional view of a system for sealing a dosing tube to an arc envelope of the lamp illustrated in FIG. 8 using a radiative heat source that heats a susceptor having a varying wall thickness according to embodiments of the present technique.

Referring now to FIG. 9, this figure illustrates a system 198 for sealing the dosing tube 182 to the arc envelope 176 of the lamp 174 of FIG. 8 in accordance with embodiments of the present technique. The system 198 includes a hollow susceptor 200 disposed on a base 202. A receptacle 204 in the susceptor 200 receives a portion 206 of the lamp 174 including the dosing tube 182. The base 202 has a receptacle 208 to receive another portion 210 of the lamp 174 including the arc envelope 176. A frit 212 is suitably positioned in a sealing region 214 between the dosing tube 182 and the arc envelope 176. As described above, in certain embodiments, no sealing material is disposed between the dosing tube 182 and the arc envelope 176, and sealing between them is achieved by diffusion bonding. The susceptor 200 has a wall 216, which surrounds the portion 206 of the lamp 174 and has a varying thickness 218 in the sealing region 214. For example, the varying thickness 218 may have a linearly changing geometry, a curved geometry (e.g., concave, convex, exponential, etc.), a stepped geometry, or any other suitable geometry. The system 198 may include a thermally insulating layer 219 as described earlier, to block heat transfer or radiative heat-generating emissions from the susceptor 200 into the base 202 and the portion 210 disposed therein. The system 198 is hermetically sealed by an outer enclosure 220, which may be internally in vacuum or filled with an inert gas in certain embodiments. A radiative heat source 222 having an RF power source 224 coupled to an induction coil 226 is employed to heat the susceptor 200. In turn, the heat susceptor 200 radiates heat into the sealing region 214 to melt the frit 212 or to facilitate material diffusion at the interfacing surfaces of the dosing tube 182 and the arc envelop 176, thereby producing a hermetical seal between one another. As can be appreciated, several embodiments of the radiative heat source 222 may fall within the scope of the present technique. As described above, the heat radiated by the susceptor 200 has a varying profile in the sealing region 214 to provide a high temperature gradient in the sealing region 214. This temperature gradient controls the depth and other characteristics of the seal.

Figure 10:
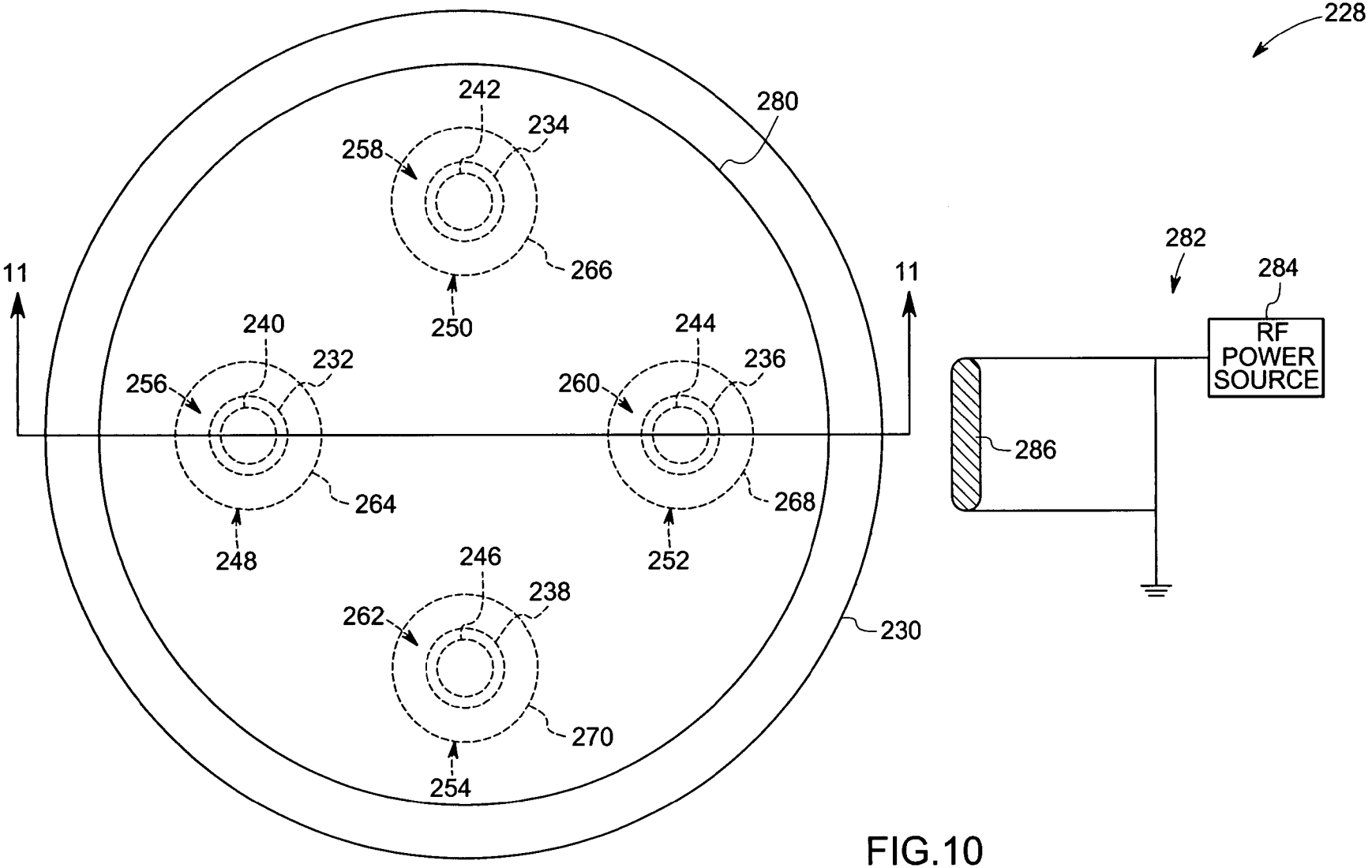
FIG. 10 is a top view of a system for sealing a plurality of lamps including a plurality of susceptors having a varying wall thickness about the lamps in accordance with one embodiment of the present technique.
Figure 11:
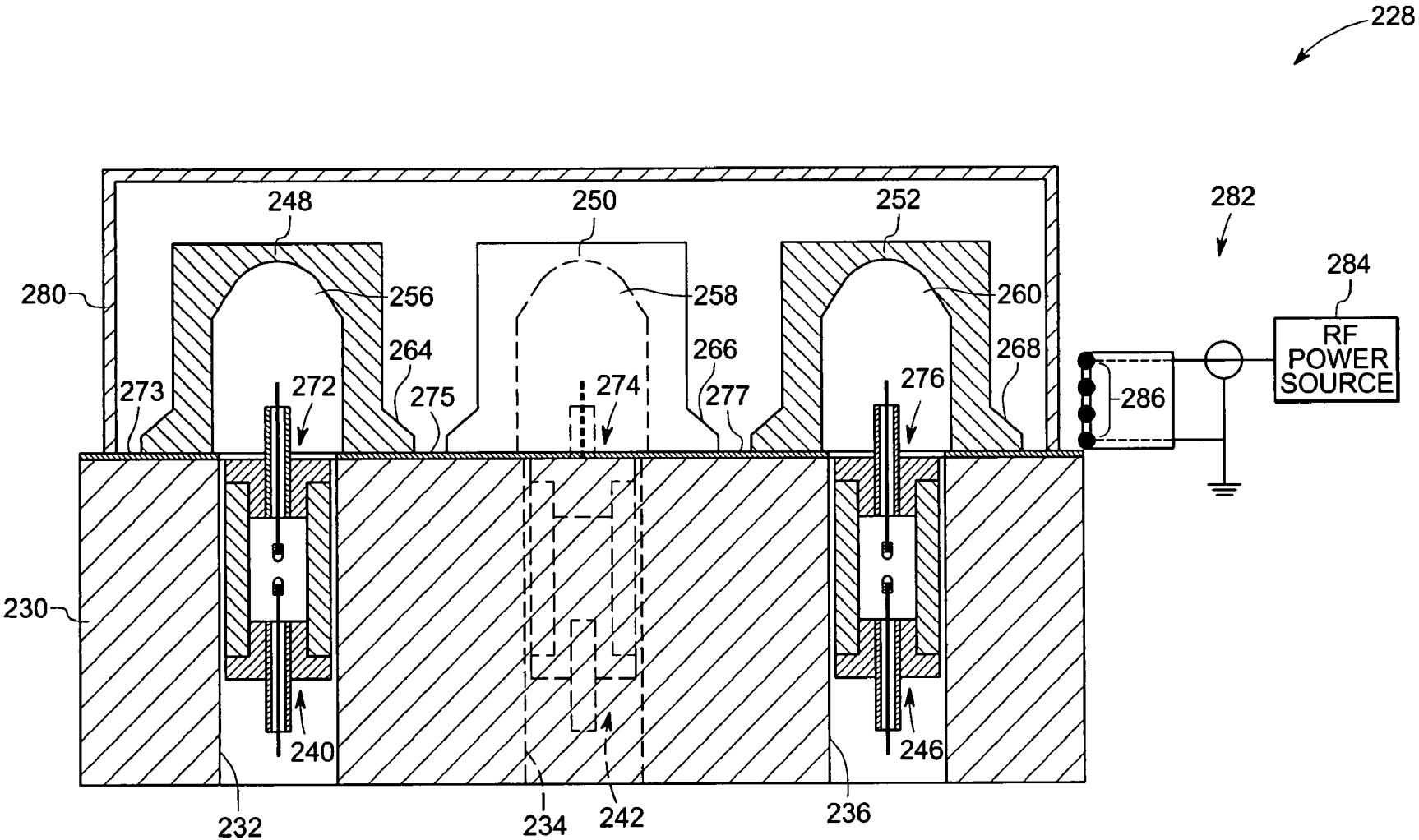
FIG. 11 is a cross-sectional side view of the system of FIG. 10 for sealing a plurality of lamps in accordance with embodiments of the present technique.

Certain embodiments of the present technique provide sealing systems to seal a plurality of lamps in one sealing cycle. Referring to FIGS. 10 and 11, these figures illustrate a system 228 for sealing a plurality of lamps in accordance with certain embodiments of the present technique. FIG. 10 is a top view of the system 228, while FIG. 11 is a cross sectional view of the system 228 along the section 11-11 of FIG. 10. Referring generally to FIGS. 10 and 11, the illustrated system 228 can be used to seal four lamps in one sealing cycle. The system 228 includes a base 230 having receptacles 232, 234, 236 and 238 adapted to receive a first portion of each of the lamps 240, 242, 244 and 246, respectively. The system also includes thermally susceptible enclosures or susceptors 248, 250, 252 and 254 having receptacles 256, 258, 260 and 262 adapted to receive a second portion of the lamps 240, 242, 244 and 246, respectively. As in the earlier embodiments, the susceptors 248, 250, 252 and 254 have walls 264, 266, 268 and 270 having a varying thickness in sealing regions 272, 274, 276 and 278, respectively (see FIG. 11). The system 228 may include thermally insulating layers 273, 275, 277, 279 to block heat transfer or radiative heat-generating emissions from the susceptors 248, 250, 252, 254 into the base 230. The system 228 further includes an outer enclosure 280 to substantially seal the sealing region therein. Moreover, the outer enclosure 280 may be in vacuum or filled with an inert gas to reduce undesirable effects of thermally sealing the lamps. The susceptors 248, 250, 252 and 254 are heated by a radiative heat source 282, which may include an RF power source 284 coupled to an induction coil 286, amongst other embodiments of the radiative heat source. In certain embodiments, heating of the susceptors 248, 250, 252 and 254 is facilitated via rotation of the induction coil 286 about the enclosure 280. In alternative embodiments, the base 230 may rotatable to facilitate heating of the susceptors 248, 250, 252 and 254 by the induction coil. In further embodiments, both the base 230 and the induction coil 286 may be rotated to facilitate heating of the susceptors 248, 250, 252 and 254. In yet another embodiment, the induction coil may comprise a solenoid that annularly encircles the outer enclosure 280. The susceptors 248, 250, 252 and 254 then radiate heat to the respective sealing regions 272, 274, 276 and 278. Again, the varying thicknesses of the walls 264, 266, 268, and 270 facilitate a varying heat profile, which provide desirable sealing characteristics as discussed above.

Figure 12:
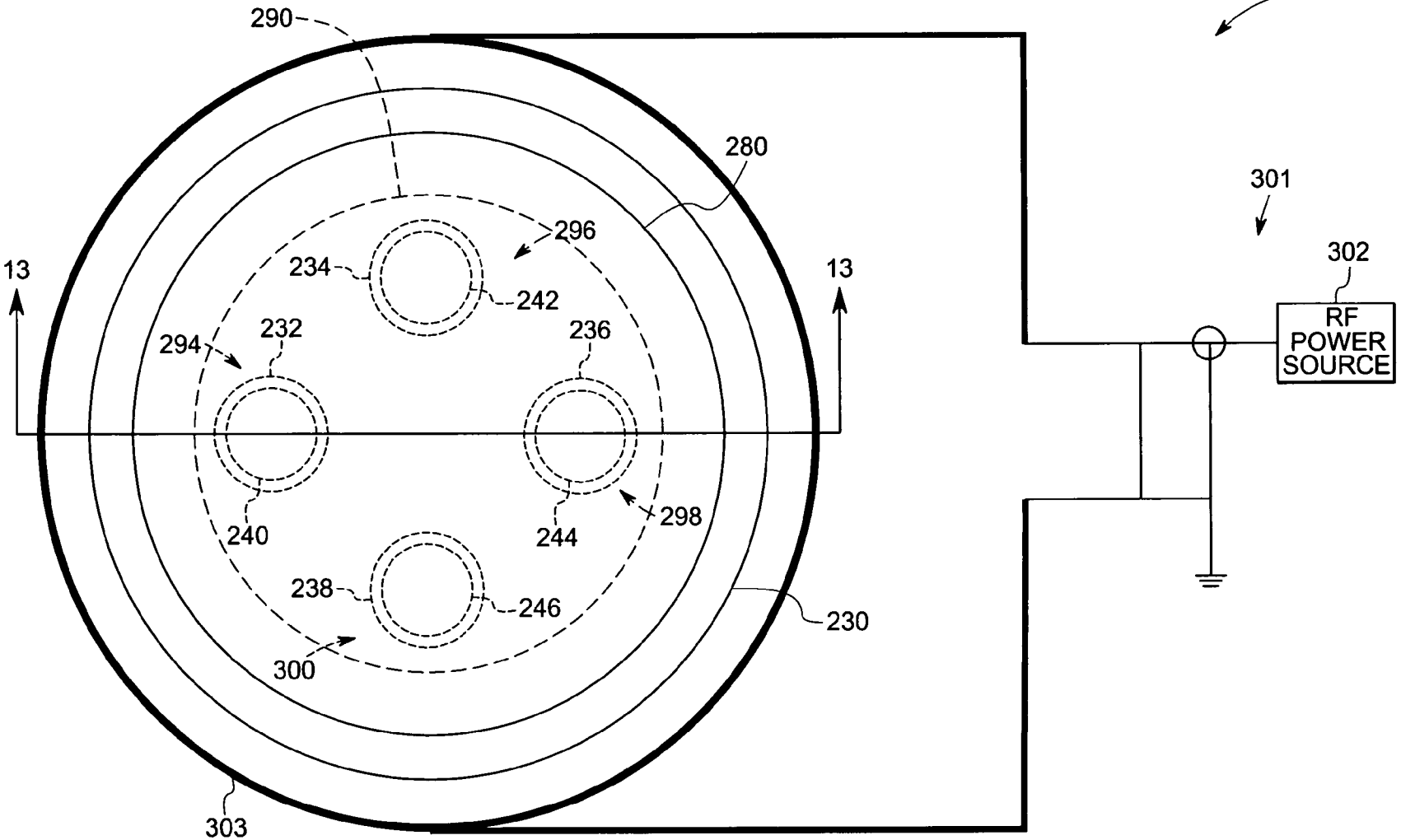
FIG. 12 is a top view of a system for sealing a plurality of lamps including a single susceptor having a varying wall thickness disposed about the plurality of lamps in accordance with another embodiment of the present technique.
Figure 13:
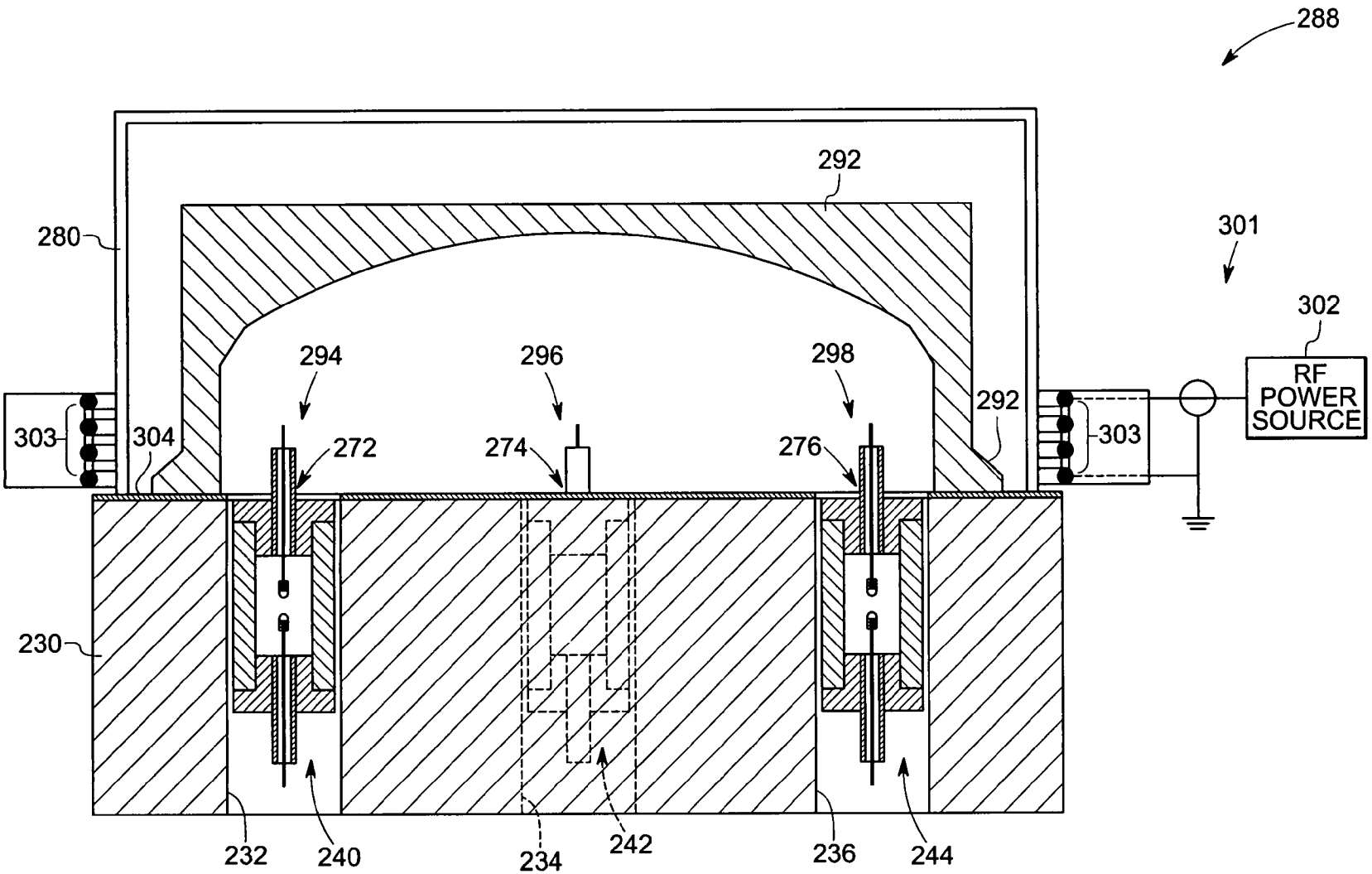
FIG. 13 is a cross-sectional side view of the system of FIG. 12 for sealing a plurality of lamps in accordance with embodiments of the present technique.

In a different embodiment of the above technique, a single susceptor having multiple receptacles may be used in place of multiple susceptors. Such an embodiment is illustrated referring generally to FIGS. 12 and 13. FIG. 12 illustrates a top view of a system 288 according to the above embodiment. FIG. 13 is a cross sectional view of the system 288 along a section cut by the plane 13-13 in FIG. 12. Referring generally to FIGS. 12 and 13, the system 288 is configured similarly to the system 228 of FIGS. 10 and 11. However, the system 288 illustrated in FIGS. 12 and 13 includes a single susceptor 290 disposed on the base 230. As further illustrated in FIG. 13, the susceptor 288 has a wall 292 of varying thickness to facilitate a varying heat profile, which controls the sealing characteristics in the components being sealed. The susceptor 290 in the illustrated embodiment has receptacles 294, 296, 298 and 300 to accommodate the second portions of the lamps 240, 242, 244 and 246, respectively. In the illustrated embodiment, the susceptor 290 is heated by an annular shaped radiative heat source 301 including an RF power source 302 coupled to a solenoid coil 303 annularly encircling the outer enclosure 280. The system 288 may include a thermally insulating layer 304 to block heat transfer or radiative heat-generating emissions from the susceptors 248, 250, 252, 254 into the base 230.

Figure 14:
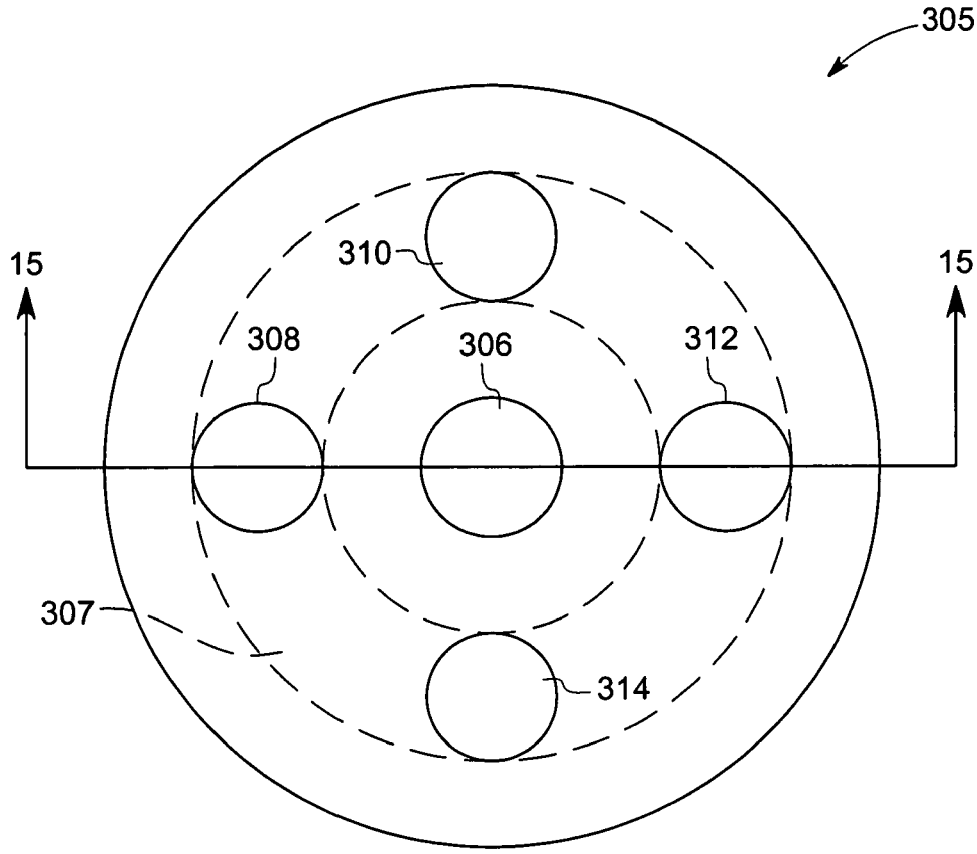
FIG. 14 is a top view of a thermal cooling base having passages for circulation of a cooling fluid according to embodiments of the present technique.
Figure 15:
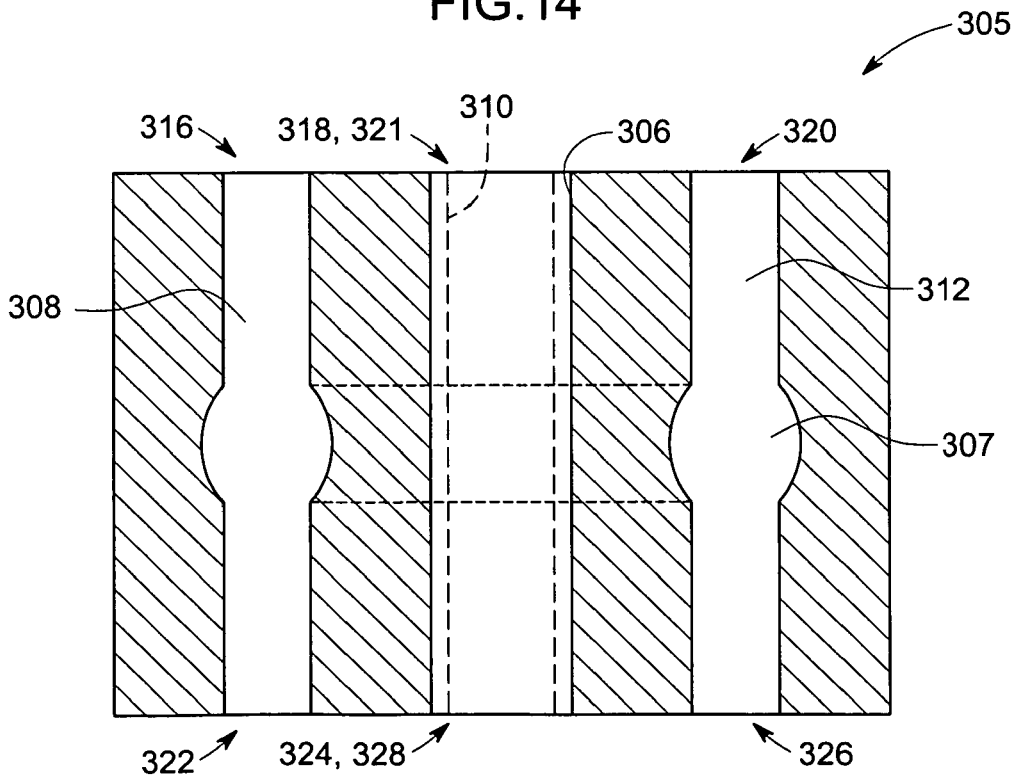
FIG. 15 is a cross-sectional side view of the thermal cooling base of FIG. 14 in accordance with embodiments of the present technique.

FIGS. 14 and 15 illustrate an exemplary base 305 used for sealing a lamp in accordance with embodiments of the present technique. FIG. 14 represents a top view while FIG. 15 represents a cross sectional view of the base 305 along the section 15-15. As illustrated, the base 305 has a receptacle 306, which extends axially through the base 302. The receptacle 306 is adapted to receive a portion of the lamp to be thermally shielded or cooled during the sealing process. Accordingly, the shape and/or size of the receptacle 306 may vary depending upon the components of the lamp to be sealed. In the illustrated embodiment, the base 305 also includes an annular circumferential passage 307 for circulation of a cooling fluid. The base 304 also includes passages 308, 310, 312 and 314 parallel to an axial direction and adapted to facilitate entry and exit of the cooling fluid through the annular passage 307. Accordingly, the passages 308, 310, 312 and 314 may be coupled to respective fluid inlets 316, 318, 320 and 321 and respective fluid outlets 322, 324, 326 and 328, or vice versa. In the illustrated embodiment, the passages 308, 310, 312 and 314 are coupled to fluid inlets at the top and fluid outlets at the bottom. In a different embodiment, the passages 308, 310, 312 and 314 may be coupled to fluid inlets at the bottom and fluid outlets at the top. In one embodiment, the cooling fluid is water. In another embodiment, the cooling fluid may include a liquefied gas, such as liquid nitrogen. Other examples of the cooling fluid may include water-oil mixture, water-glycol mixture, or liquid metals, such as tin, lead, tin-lead alloys, sodium-potassium alloys, amongst others. The above embodiment is advantageous because liquid nitrogen provides sufficient cooling of the arc envelope to freeze certain undesirable elements such as xenon, which may be present in certain embodiments of the dosing material disposed inside the lamp.

Figure 16:
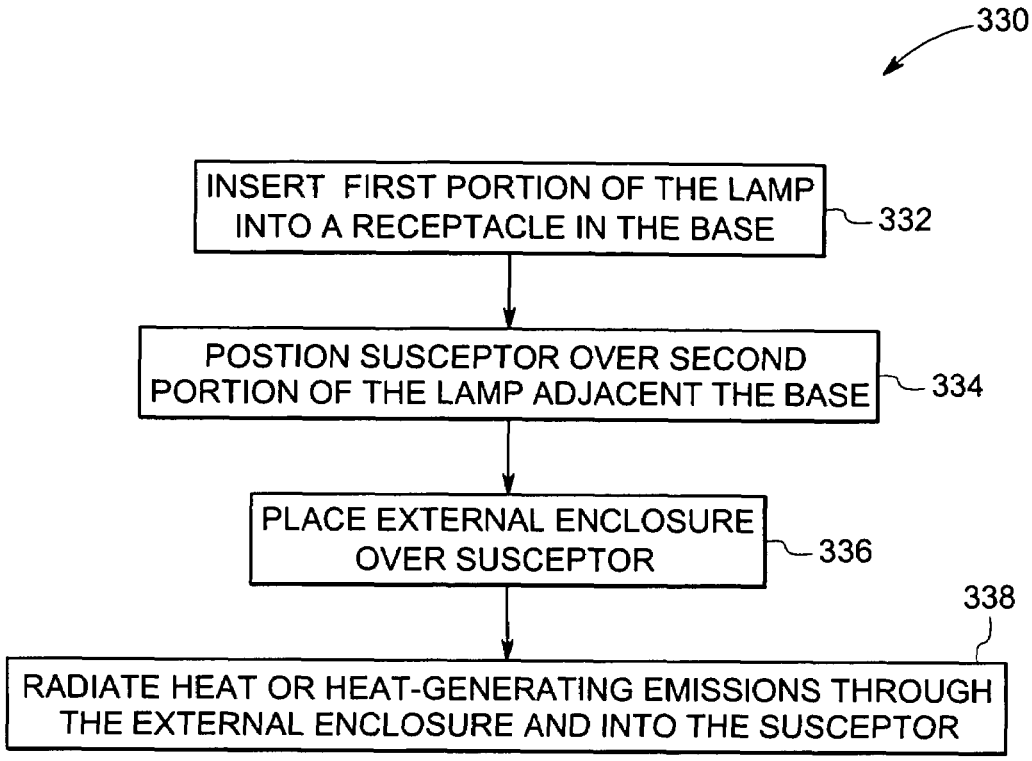
FIG. 16 is a flow chart illustrating an exemplary method of manufacturing a lamp in accordance with embodiments of the present technique.

FIG. 16 is a flow chart illustrating an exemplary process 330 of manufacturing a lamp in accordance with embodiments of the present technique. With reference to the lamps described above with reference to FIG. 1 and FIG. 8 among others, the process 330 begins by inserting a first portion of the lamp into a receptacle of a base (block 332). The base is adapted to provide a thermal shield and/or cooling to the first portion of the lamp. At block 334, the process 330 proceeds by positioning a thermally susceptible enclosure, such as a susceptor, over a second portion of the lamp and adjacent to the base. The thermally susceptible enclosure has a wall, which includes at least a portion having a varying thickness. The process positions the thermally susceptible enclosure such that the portion of the wall having the varying thickness is disposed about a sealing region between the first and the second portions of the lamp. At block 336, the process 330 continues by placing an external enclosure about the thermally susceptible enclosure to provide a hermetically sealed chamber about the desired sealing region therein. The block 336 also may include configuring the interior of the external enclosure to be in vacuum or filled with an inert gas. At block 338, the process 330 proceeds by radiating heat or heat-generating emissions through the external enclosure and into the thermally conductive enclosure thermally susceptible enclosure. As explained above, this radiation causes the thermally susceptible enclosure to heat up and, in turn, radiate heat into the desired sealing region with a variable heat profile based on the varying thickness. Further, as explained in detail above, the first and second portions of the lamp can include a dosing tube, an arc envelope, an end structure, a lead wire, or any combinations thereof.

Figure 17:
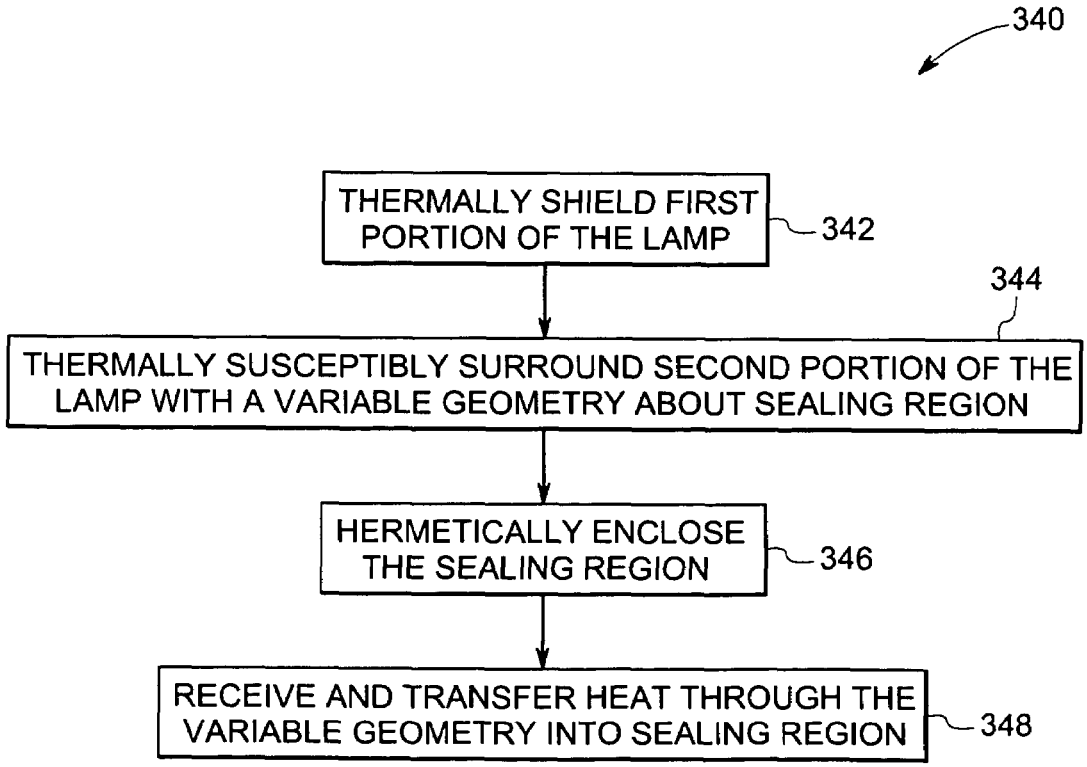
FIG. 17 is a flow chart illustrating an exemplary method of sealing a lamp in accordance with embodiments of the present technique.

FIG. 17 is a flow chart illustrating an exemplary process 340 of sealing a lamp in accordance with embodiments of the present technique. With reference to the lamps described above with reference to FIG. 1 and FIG. 8 among others, the process 340 begins by thermally shielding a first portion of the lamp (block 342). The act of thermally shielding may include blocking heat, dissipating heat, or generally reducing undesirable heating of the first portion of the lamp. For example, block 342 may include positioning the first portion of the lamp in a receptacle of a base, which provides a thermal shield and/or cooling mechanisms about the first portion of the lamp. At block 344, the process 340 continues by thermally susceptibly surrounding a second portion of the lamp with a variable geometry along a desired sealing region between the first and second portions. The variable geometry is adapted to provide variable heat susceptibility along the desired sealing region. At block 346, the process 340 proceeds by hermetically enclosing the desired sealing region. Embodiments of block 346 include enclosing the sealing region in vacuum or with a desired substance, such as an inert gas. At block 348, the process 340 continues by radiatively receiving and transferring heat through the variable geometry and into the desired sealing region with a variable heat profile based on the variable heat susceptibility. As described in detail above, block 348 may include melting of a seal material such that the seal material flows in the desired sealing region between the first and the second portions of the lamp. Alternatively, block 348 may include diffusion bonding the first or the second portions of the lamp in the desired sealing region.

As will be appreciated, various embodiments of the present technique can be used to seal a wide variety of lamp components. Such components may have varied geometries and may include, for example, arc envelopes, dosing tubes or passageways, electrode lead wires, end structures, amongst others. An important advantage of the present technique is that it can be used for arc tubes and other components having a wide variety of material composition.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system for sealing a lamp, comprising:

a thermal control structure having a first receptacle adapted to receive a first portion of the lamp; and a thermally susceptible enclosure disposed adjacent the thermal control structure, wherein the thermally susceptible enclosure comprises a wall about a second receptacle adapted to receive a second portion of the lamp, wherein the wall has a varying thickness in a desired sealing region between the first and second portions of the lamp.

2. The system of claim 1, wherein the thermal control structure is adapted to substantially reduce heating of a dosing substance disposed within the lamp.

3. The system of claim 1, wherein the varying thickness is adapted to provide a desired heat profile in the desired sealing region.

4. The system of claim 1, further comprising an outer sealing enclosure disposed about the thermally susceptible enclosure adjacent the thermal control structure, wherein the outer sealing enclosure is adapted to substantially seal the desired sealing region therein.

5. The system of claim 4, comprising an inert gas disposed inside the outer sealing enclosure in pneumatic communication with the desired sealing region.

6. The system of claim 4, further comprising a radiative heat source disposed outside the outer sealing enclosure, the radiative heat source being adapted to radiate emissions through the outer sealing enclosure and into the thermally susceptible enclosure, wherein the thermally susceptible enclosure is adapted to become heated by the emissions and to radiate heat into the desired sealing region in a varying heat profile based on the varying thickness.

7. The system of claim 6, wherein the radiative heat source comprises a radio frequency (RF) heating device.

8. The system of claim 6, wherein the radiative heat source comprises a laser.

9. The system of claim 1, wherein the thermal control structure has a fluid passage adapted to circulate a fluid for cooling the first portion of the lamp.

10. The system of claim 9, wherein the fluid passage comprises a passageway extending substantially around the first receptacle.

11. The system of claim 9, comprising a liquefied gas source coupled to the fluid passage.

12. The system of claim 1, wherein the thermal control structure comprises a material including copper.

13. The system of claim 1, wherein the thermally susceptible enclosure comprises graphite.

14. The system of claim 1, wherein the first portion or the second portion comprises an arc envelope, an end structure, a dosing tube, or an electrode lead wire, or any combination thereof.

15. A system for sealing a lamp, comprising:

a thermal control structure having a first receptacle adapted to receive a first portion of the lamp;

a thermally susceptible enclosure disposed adjacent the thermal control structure, wherein the thermally susceptible enclosure comprises a wall adapted to substantially surround a second portion of the lamp, wherein the wall has a varying thickness in a desired sealing region between the first and second portions of the lamp;

an outer sealing enclosure disposed about the thermally susceptible enclosure adjacent the thermal control structure; and a radiative heat source adapted to radiate emissions into the thermally susceptible enclosure, wherein the thermally susceptible enclosure is adapted to become heated by the emissions and to radiate heat into the desired sealing region in a varying heat profile based on the varying thickness.

16. The system of claim 15, wherein the thermal control structure is adapted to substantially reduce heating of a dosing substance disposed within the lamp.

17. The system of claim 15, wherein the thermally susceptible enclosure comprises graphite.

18. The system of claim 15, wherein the thermal control structure comprises a fluid passage adapted to circulate a fluid for cooling the first portion of the lamp.

19. The system of claim 15, wherein the radiative heat source comprises a radio frequency (RF) heating device.

20. The system of claim 19, wherein the radio frequency (RF) heating device comprises a pancake-configured coil adapted to be positioned aside the desired sealing region.

21. The system of claim 19, wherein the radio frequency (RF) heating device comprises an annularly-configured coil adapted to encircle the desired sealing region.

22. The system of claim 15, wherein the radiative heat source comprises a laser.

23. The system of claim 15, wherein the first portion or the second portion comprise a ceramic material including polycrystalline alumina, sapphire, single crystal yttrium aluminum garnet, or polycrystalline yttrium aluminum garnet, or any combination thereof.

24. The system of claim 15, wherein the first portion comprises an end structure and the second portion comprises a dosing tube.

25. The system of claim 15, wherein the first portion comprises an arc envelope and the second portion comprises an end structure.

26. The system of claim 15, wherein the first portion comprises a dosing tube and the second portion comprises an electrode lead wire.

27. A system for sealing a plurality of lamps, comprising:

a thermal control structure having a first plurality of receptacles adapted to receive a first portion of each of the plurality of lamps, respectively; and a thermally susceptible enclosure disposed adjacent the thermal control structure, wherein the thermally susceptible enclosure comprises a wall about a second portion of each of the plurality of lamps, wherein the wall has a varying thickness in a desired sealing region between the first and second portions of the plurality of lamps.

28. The system of claim 27, wherein the varying thickness is adapted to provide a desired heat profile in the desired sealing region.

29. The system of claim 27, comprising a separate thermally susceptible enclosure for each of the plurality of lamps, each of the separate thermally susceptible enclosures having a varying wall thickness in a sealing region between the first and second portions of one of the plurality of lamps.

30. The system of claim 27, wherein the thermally susceptible enclosure comprises a second plurality of receptacles adapted to receive the second portion of each of the plurality of lamps, respectively, each of the second plurality of receptacles having a varying wall thickness in a sealing region between the first and second portions.

31. The system of claim 27, further comprising an outer sealing enclosure disposed about the thermally susceptible enclosure adjacent the thermal control structure, wherein the outer sealing enclosure is adapted to substantially seal the desired sealing region of the plurality of lamps therein.

32. The system of claim 27, further comprising a radiative heat source adapted to radiate emissions into the thermally susceptible enclosure, wherein the thermally susceptible enclosure is adapted to become heated by the emissions and to radiate heat into the desired sealing region in a varying heat profile based on the varying thickness.

33. The system of claim 32, wherein the radiative heat source comprises an induction heating device, a laser, or a resistance heating device.

34. The system of claim 32, wherein the radiative heat source comprises a radio frequency induction coil coupled to a source of radio frequency power.

35. The system of claim 32, wherein the radiative heat source comprises a laser.

36. The system of claim 32, wherein the radiative heat source comprises a power source coupled to a coil that annularly encircles the desired sealing region.

37. A system for sealing a lamp, comprising: means for controlling heat transfer in a first portion of the lamp; and means for radiating heat collected from a radiative heat source through a varying thickness wall to a second portion of the lamp in a desired sealing region between the first and second portions of the lamp, the heat having a variable heat profile in the desired sealing region.

38. The system of claim 37, comprising means for externally enclosing the desired sealing region.

39. The system of claim 37, comprising means for generating heat at the radiative heat source.

40. A method of manufacturing a lamp, comprising:

inserting a first portion of the lamp into a receptacle of a thermal control structure;

positioning a thermally susceptible enclosure about a second portion of the lamp adjacent the thermal control structure, such that a varying thickness of the thermally susceptible enclosure is disposed about a desired sealing region between the first and second portions;

placing an external enclosure about the thermally susceptible enclosure to provide a hermetically sealed chamber about the desired sealing region; and radiating emissions through the external enclosure and into the thermally susceptible enclosure, such that the thermally susceptible enclosure becomes heated by the emissions and radiates heat into the desired sealing region with a variable heat profile based on the varying thickness.

41. The method of claim 40, further comprising circulating a fluid within the thermal control structure for cooling the first portion of the lamp.

42. The method of claim 40, wherein radiating emissions comprises generating heat from a radio frequency (RF) heating device.

43. The method of claim 40, wherein radiating emissions comprises generating heat from a laser.

44. The method of claim 40, wherein inserting the first portion of the lamp comprises inserting an arc envelope, an end structure, or a dosing tube, or any combination thereof.

45. The method of claim 40, wherein positioning the thermally susceptible enclosure about the second portion of the lamp comprises positioning the thermally susceptible enclosure about an electrode lead wire, a dosing tube, or an end structure, or any combination thereof.

46. The method of claim 40, wherein the first and second portions comprise an electrode lead wire and a dosing tube, a dosing tube and an end structure, or an end structure and an arc envelope, respectively.

47. A lamp formed by the method of claim 40.

48. A method of sealing a lamp, comprising:

thermally shielding a first portion of the lamp;

thermally susceptibly suffounding a second portion of the lamp with a variable geometry along a desired sealing region between the first and second portions, the variable geometry adapted to provide a variable heat susceptibility along the desired sealing region;

hermetically enclosing the desired sealing region; and radiatively receiving and transfefling heat through the variable geometry and into the desired sealing region with a variable heat profile based on the variable heat susceptibility.

49. The method of claim 48, further comprising fluid cooling the first portion of the lamp.

50. The method of claim 48, wherein thermally shielding the first portion of the lamp comprises thermally shielding an arc envelope, an end structure, or a dosing tube, or any combination thereof.

51. The method of claim 48, wherein thermally susceptibly surrounding the second portion of the lamp comprises thermally susceptibly surrounding an electrode lead wire, a dosing tube, or an end structure, or any combination thereof.

52. The method of claim 48, wherein the first and second portions comprise an electrode lead wire and a dosing tube, a dosing tube and an end structure, or an end structure and an arc envelope, respectively.

53. The method of claim 48, comprising generating heat from a radio frequency (RF) heating device directed toward the desired sealing region.

54. The method of claim 48, wherein radiatively receiving and transferring heat comprises diffusion bonding the first and second portions in the desired sealing region.

55. The method of claim 48, wherein radiatively receiving and transferring heat comprises at least partially flowing a seal material in the desired sealing region between the first and second portions.

56. The method of claim 48, wherein radiatively receiving and transferring heat comprises end-to-end sealing the first and second portions in the desired sealing region.

57. The method of claim 48, comprising surrounding the desired sealing region with an inert gas.

58. A lamp formed by the method of claim 44.

* * * * *